US007514194B2

(12) United States Patent
Iijima et al.

(10) Patent No.: US 7,514,194 B2
(45) Date of Patent: Apr. 7, 2009

(54) TONER FOR DEVELOPING ELECTROSTATIC LATENT IMAGE AND PRODUCTION METHOD THEREOF, ELECTROSTATIC LATENT IMAGE DEVELOPER, IMAGE FORMING METHOD, AND IMAGE FORMING APPARATUS

(75) Inventors: Masakazu Iijima, Minamiashigara (JP); Takao Ishiyama, Minamiashigara (JP); Masaaki Suwabe, Minamiashigara (JP); Yasuo Kadokura, Minamiashigara (JP); Michio Take, Minamiashigara (JP); Hiroshi Nakazawa, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 378 days.

(21) Appl. No.: 11/303,982

(22) Filed: Dec. 19, 2005

(65) Prior Publication Data

US 2007/0009822 A1 Jan. 11, 2007

(30) Foreign Application Priority Data

Jul. 7, 2005 (JP) ..... 2005-198524

(51) Int. Cl.
*G03G 9/087* (2006.01)

(52) U.S. Cl. ..... 430/108.22; 430/108.1; 430/108.4; 430/110.2; 430/110.3; 430/119.86; 430/137.14; 430/137.15

(58) Field of Classification Search ..... 430/108.22, 430/110.2, 108.4, 108.1, 110.3, 137.14, 137.15, 430/119.86

See application file for complete search history.

(56) References Cited

U.S. PATENT DOCUMENTS 3,876,610 A * 4/1975 Timmerman et al. ..... 430/110.2
5,314,778 A * 5/1994 Smith et al. ..... 430/108.22
5,334,480 A * 8/1994 Inaba et al. ..... 430/138
5,434,030 A * 7/1995 Smith et al. ..... 430/108.22
5,536,782 A * 7/1996 Takarada et al. ..... 525/100
5,750,301 A * 5/1998 Funato et al. ..... 430/109.3

FOREIGN PATENT DOCUMENTS

| | | |
|---|---|---|
| CN | 1128871 A | 8/1996 |
| EP | 0 718 704 A1 | 6/1996 |
| JP | A 64-70765 | 3/1989 |
| JP | A 64-88556 | 4/1989 |
| JP | A 2-240663 | 9/1990 |
| JP | A 3-105350 | 5/1991 |
| JP | A 7-104514 | 4/1995 |
| JP | A 7-104515 | 4/1995 |
| JP | A 8-171234 | 7/1996 |
| JP | A 8-328311 | 12/1996 |
| JP | A 9-230628 | 9/1997 |
| JP | 09292736 A * | 11/1997 |
| JP | A 2002-123038 | 4/2002 |
| JP | A 2002-131980 | 5/2002 |

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

English language machine translation of JP 09-292736 (Nov. 1997).*

* cited by examiner

*Primary Examiner*—Christopher RoDee
(74) *Attorney, Agent, or Firm*—Oliff & Berridge, PLC

(57) ABSTRACT

The invention provides a toner for developing electrostatic latent images containing at least a binder resin, a colorant, a releasing agent, and a graft polymer that has been made by graft polymerization of a resin matrix and a macromonomer including at least one group selected from the group consisting of a hydroxyl group, a hydroxyalkyl group, and a pyrolidonyl group, and a production method thereof. The invention further provides an electrostatic latent image developer using the toner, an image forming method using the toner, and an image forming apparatus.

17 Claims, 2 Drawing Sheets

TONER FOR DEVELOPING ELECTROSTATIC LATENT IMAGE AND PRODUCTION METHOD THEREOF, ELECTROSTATIC LATENT IMAGE DEVELOPER, IMAGE FORMING METHOD, AND IMAGE FORMING APPARATUS

CROSS-REFERENCE TO RELATED APPLICATION

This application claims priority under 35 USC 119 from Japanese Patent Application No. 2005-198524, the disclosure of which is incorporated by reference herein.

BACKGROUND OF THE INVENTION

1. Field of the Invention

The present invention relates to a toner for developing electrostatic latent images and a production method thereof, an electrostatic latent image developer, an image forming method, and an image forming apparatus, used when developing a latent image formed by an electrophotographic method, an electrostatic recording method, and the like, using a developer.

2. Description of the Related Art

Impurities, in particular low molecular weight constituents having an aroma, which are included in a toner for developing electrostatic latent images (hereinafter, referred to as "toner") used in a method such as the electrophotographic method for visualizing image information through an electrostatic image, causes an undesirable situation when using the toner, such as giving discomfort in the form of an odor at the time of opening the toner container.

As a method of fixing a toner onto the surface of a copying paper in the fixing step, a pressure fixing method, a heat fixing method, and the like are used. Examples of a heat fixing method include an oven fixing method, a flash fixing method, a pressure fixing method, and a heated roller fixing method. In an electrophotographic copier and the like, in general, the heated roller fixing method is widely used. In the method, the heating efficiency when the surface of a heated roller and the sheet image to be fixed are fusion bonded onto a sheet to be fixed, is excellent, enabling rapid fixing. In particular, the method is very effective as a fixing method at the time of high speed copying.

However, in the heat fixing method, since the toner image is heated, trace constituents, in particular the abovementioned low molecular weight constituents having an aroma, and the like included in the toner, are released into the atmospheric air, which may give an unpleasant odor to the user in some cases. Furthermore, recently, with the miniaturization of copiers and printers, there are more and more occasions where such devices are familiarly used in offices and the like. Moreover, there are increased occasions where they are used in ordinary homes, resulting in an increase in cases where the odor generated from the toner, brings discomfort to the user.

One of the causes of an odor being generated from an electrophotographic device, is ozone generation due to corona discharge. However, by contact charging methods such as roller charging, brush charging, and the like, or by technological innovation such as a corona discharger which minimizes the ozone generation, the ozonic odor has been greatly reduced, but relatively, cases where toner odor caused by the toner brings discomfort have increased. Moreover, since ozone, odor, and the like are absorbed into the mainframe, there is also a case where a filter and the like are attached. However, with a filter there is the problem of periodic exchange and the like in order to maintain the deodorizing function, which is also a disadvantage in terms of production cost.

Other methods of reducing the odor originating in the toner include a conventional method of reducing impurities in the binder resin. For example, in Japanese Unexamined Patent Publication No. Sho 64-70765, Japanese Patent Application Laid-Open (JP-A) Nos. 64-88556, and 8-328311, there is proposed a method of reducing odor by reducing residual monomers in the binder resin.

Moreover, assuming that only a reduction in the volatile constituents included in the resin is not sufficient, since odor generation can be caused by volatiles that have been generated during the toner production process by decomposition of chemically unstable substances, a trace of which is included in the raw material, then as a countermeasure against the odor of the overall final toner product, there is disclosed a technique of removing the odor of the raw materials, for example in JP-A Nos. 7-104515, and 7-104514.

Moreover, assuming that the causative substance of odor is oxidation products of benzaldehyde included in the toner, then for example as disclosed in JP-A No. 8-171234, an approach to reduce the contents of benzaldehyde has been made.

Meanwhile, for example in JP-A No. 9-230628, a scheme has been devised to improve the odor, and at the same time to prevent the negative effect on the fixity, by reducing the usage of alkymercaptan (one of the causative substances of odor generation) which is a molecular weight control agent for resin, and is essential for the basic function of the toner, while controlling it to the minimum requirement.

Moreover, for example in JP-A No. 3-105350, an approach has been made to add alkylbetaine compounds into the toner, as a substance which reacts with odorous substances and absorbs them. Furthermore, for example in JP-A No. 2002-123038, an approach has been made to add phytoncides, catechines, and metallophthalocyanines into the toner. Moreover, for example, in JP-A No.2002-131980, an approach is described to add macrocyclic lactone and macrocyclic ketone compounds with the object of neutralizing the odor of a chain transfer agent in the polymerization toner resin.

However, these methods can not avoid the absorption and the like of other active toner constituents due to the structure of the compound, which tends to result in deterioration of the key qualities as a toner, such as the charging characteristic and the like.

Furthermore, for example in JP-A No. 2-240663, there is described a method of bringing deodorizer and toner into contact for 5 hrs or more in the crushing and classifying steps, so as to deodorize it. However, in this method, the production takes a long time, and the odor generated after completing the production is not necessarily sufficiently reduced.

SUMMARY OF THE INVENTION

The present invention has been made in view of the above circumstances, and provides a toner for developing electrostatic latent images and production method thereof, an electrostatic latent image developer, an image forming method, and an image forming apparatus.

A first aspect of the present invention provides a toner for developing electrostatic latent images comprising at least a binder resin, a colorant, a releasing agent, and a graft polymer that has been made by graft polymerization of a resin matrix and a macromonomer including at least one group selected from the group consisting of a hydroxyl group, a hydroxyalkyl group, and a pyrolidonyl group.

A second aspect of the present invention provides a method of producing the toner of the present invention comprising: mixing at least a binder resin particle dispersion liquid in which a binder resin having a particle diameter of 1 μm or less is dispersed, a colorant dispersion liquid in which a colorant is dispersed, a releasing agent dispersion liquid in which a releasing agent is dispersed, and a graft polymer that has been made by graft polymerization of a resin matrix and a macromonomer including at least one group selected from the group consisting of a hydroxyl group, a hydroxyalkyl group, and a pyrolidonyl group, so as to form aggregated particles containing at least the binder resin and the colorant; and heating the aggregated particles to a temperature equal to or greater than the glass transition point or the melting point of the binder resin, so as to fuse and coalesce them.

A third aspect of the present invention provides an electrostatic latent image developer containing at least the toner of the present invention.

A fourth aspect of the present invention provides an image forming method comprising: image forming method comprising: uniformly charging the surface of an image holding material; forming a latent image on the surface of the charged image holding material; developing the latent image that has been formed on the surface of the image holding material with a developer having at least a toner, so as to form a toner image; transferring the toner image that has been formed on the surface of the image holding material onto a transfer material; fixing the toner image that has been transferred onto the transfer material; and removing residual toner on the surface of the image holding material after the transferring, wherein the developer is the electrostatic latent image developer of the present invention.

A fifth aspect of the present invention provides an image forming apparatus comprising: An image holding material; a charging device which uniformly charges the image holding material; a latent image forming device which forms a latent image on a surface of the charged image holding material; a developing device which develops the latent image that has been formed on the surface of the image holding material with a developer having at least a toner, so as to form a toner image; a transferring device which transfers the toner image that has been formed on the surface of the image holding material onto a transfer material; a fixing device which fixes the toner image that has been transferred onto the transfer material; and a cleaning device which removes residual toner on the surface of the image holding material after the transferring, wherein the developer is the electrostatic latent image developer of the present invention.

DETAILED DESCRIPTION OF THE INVENTION

Figure 1:
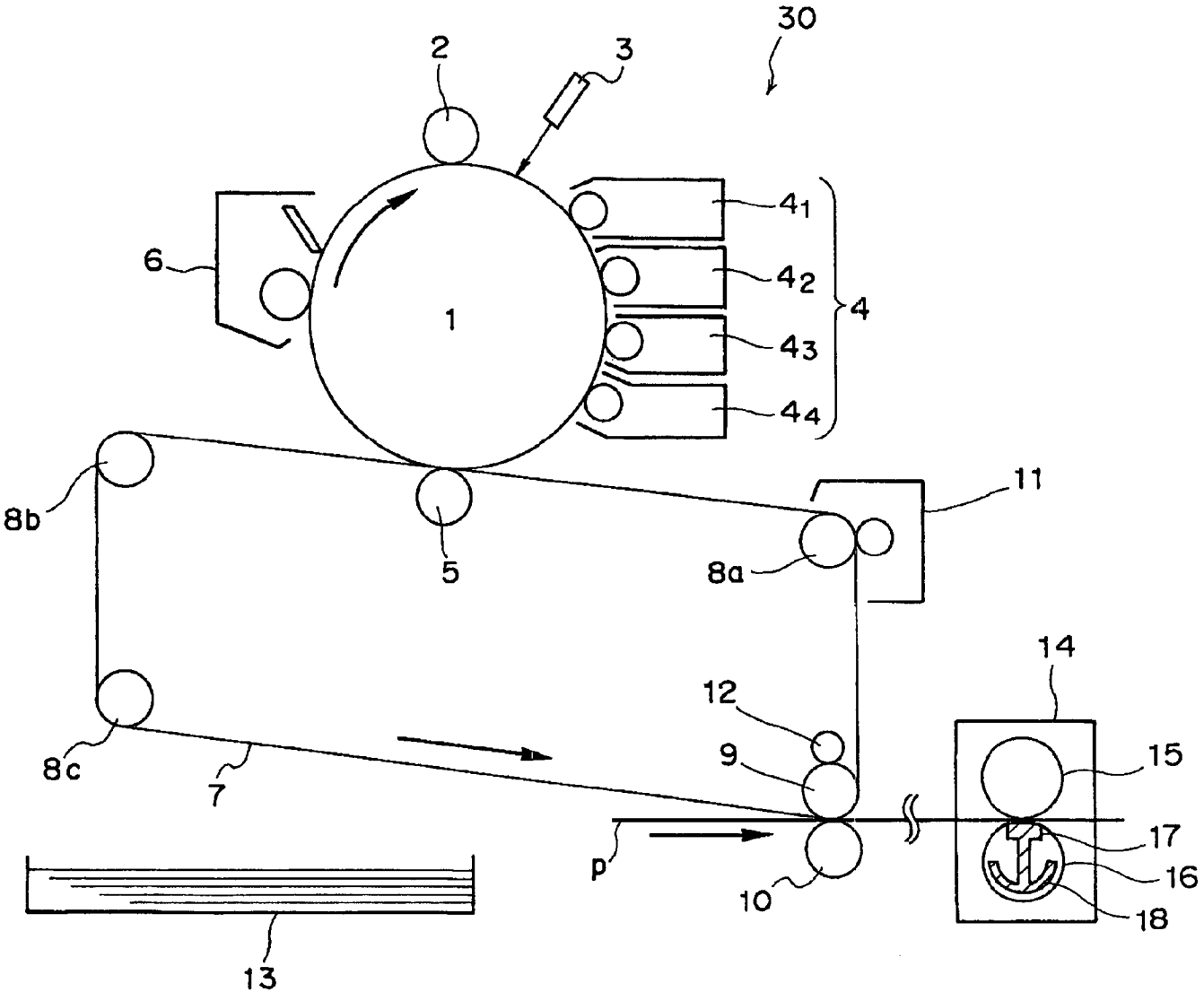
FIG. 1 shows a first embodiment of an image forming apparatus of the present invention.

Hereinafter, a toner for developing electrostatic latent images and a production method thereof, an electrostatic latent image developer, an image forming method, and an image forming apparatus of the present invention will be described in detail.

<Toner for Developing Electrostatic Latent Images>

The toner for developing electrostatic latent images of the present invention comprises at least a binder resin, a colorant, a releasing agent, and a graft polymer that has been made by graft polymerization of a resin matrix and a macromonomer including at least one group selected from the group consisting of a hydroxyl group, a hydroxyalkyl group, and a pyrolidonyl group.

Since the toner for developing electrostatic latent images of the present invention contains a graft polymer including a macromonomer having an adsorptivity of polar substances as a side chain thereof, then substances causing odor annoyance can be removed from the atmospheric air. Therefore, by using the toner for developing electrostatic latent image of the present invention, odor generation at the time of fixing the toner can be suppressed.

—Graft Polymer—

The graft polymer according to the present invention is made by graft polymerization of a resin matrix and a macromonomer which includes at least one group selected from the group consisting of a hydroxyl group, a hydroxyalkyl group, and a pyrolidonyl group.

The graft polymer according to the present invention that has been bonded by graft polymerization of the macromonomer and the resin matrix is obtained by graft polymerizing a resin matrix with a macromonomer including a functional group having an adsorptivity of polar substances. Moreover, the macromonomer is made by polymerization of reactive monomers which will be described later.

In the present invention, "macromonomer" denotes a high molecular weight monomer having a polymerizable functional group. The degree of polymerization of the macromonomer according to the present invention is preferably 10 to 100, and more preferably 50 to 100. That is, the macromonomer of the present invention is made by polymerization of reactive monomers including a functional group having an adsorptivity of polar substances, and preferably has a degree of polymerization of 10 to 100.

The macromonomer according to the present invention includes at least one group selected from the group consisting of a hydroxyl group, a hydroxyalkyl group, and a pyrolidonyl group. If the macromonomer according to the present invention includes such functional groups, by the polarity of these functional groups, traces of odorous constituents present in the binder resin can be absorbed by the hydrogen bond or the like, preventing them from releasing to out of the toner. Moreover, since these macromonomers are contained in the binder resin, volatiles that have been generated by heating at the time of fixing and the like can be rapidly absorbed.

As a functional group included in the macromonomer according to the present invention, a hydroxyalkyl group and a pyrolidonyl group are particularly preferred.

Specific examples of the reactive monomer used for introducing at least one group selected from the group consisting of a hydroxyl group, a hydroxyalkyl group, and a pyrolidonyl group into the macromonomer include: vinylpyrrolidone, hydroxypropyl acrylate, hydroxyethyl methacrylate, dimethylacrylamide, ethyleneglycol monoacrylate, ethyleneglycol monomethacrylate, ethyleneglycol diacrylate, ethyleneglycol dimethacrylate, triethyleneglycol methacrylate, and triethyleneglycol diacrylate. Among them, preferred are vinylpyrrolidone and hydroxyethyl methacrylate.

The macromonomer according to the present invention may further include a cationic leaving group. In the present invention, the "cationic leaving group" denotes an ion exchange group having a cationic counter ion. A typical cationic leaving group is an acidic group. The cationic leaving group has an adsorptivity of polar substances, and is capable of releasing protons (hydrogen ions) to neutralizingly react with basic substances such as ammonia and amines. As a result, the basic substances are removed. One or more types of cationic leaving group(s) may be introduced into the macromonomer.

The cationic leaving group is preferably at least one group selected from groups comprising for example, a carboxyl group, a sulfone group, a phosphate group, a sulfoethyl group, a phosphomethyl group, and a carbomethyl group. Among them, preferred are a sulfone group and a carboxyl group.

Specific examples of the reactive monomer used for introducing the cationic leaving group into the macromonomer include: acrylic acid, methacrylic acid, styrenesulfonic acid, and salts thereof, and 2-acrylamide-2-methylpropanesulfonic acid. Moreover, the reactive monomer having a group that can be exchanged into the cationic leaving group is also useful in the present invention. Examples of such a reactive monomer include glycidyl methacrylate and glycidyl acrylate.

The macromonomer according to the present invention may further include an anionic leaving group. In the present invention, the "anionic leaving group" denotes an ion exchange group having an anionic counter ion. A typical anionic leaving group has an adsorptivity of polar substances, and is capable of neutralizingly reacting with acidic substances such as hydrogen sulphide and mercaptans. As a result, the acidic substances are removed. One or more types of anionic leaving group(s) may be introduced into the macromonomer.

Examples of the anionic leaving group include a quaternary ammonium group and a primary to tertiary amino group such as an amino group, a methylamino group, a dimethylamino group, and a diethylamino group. Among them, preferred is at least one group selected from groups comprising a primary to tertiary amino group and a quaternary ammonium group.

Specific examples of the reactive monomer used for introducing the anionic leaving group into the macromonomer include: vinylbenzyltrimethyl ammonium salt, diethylaminoethyl methacrylate, dimethylaminoethyl acrylate, dimethylaminoethyl methacrylate, diethylaminoethyl acrylate, diethylaminomethyl methacrylate, tertiary butylaminoethyl acrylate, tertiary butylaminoethyl methacrylate, and dimethylaminopropyl acrylamide. Among them, particularly useful reactive monomers are vinylbenzyltrimethyl ammonium salt and diethylaminoethyl methacrylate. Moreover, the reactive monomer having a group that can be exchanged into the anionic leaving group is also useful in the present invention. An example of such a reactive monomer includes chloromethylstyrene.

The macromonomer according to the present invention includes at least one group selected from the group consisting of a hydroxyl group, a hydroxyalkyl group, and a pyrolidonyl group, in which as required, one or more types of cationic leaving group(s) and/or anionic leaving group(s) may be present.

As the combination of functional groups included in the macromonomer according to the present invention, there are combinations of: a cationic leaving group, and at least one group selected from the group consisting of a hydroxyl group, a hydroxyalkyl group, and a pyrolidonyl group; an anionic leaving group, and at least one group selected from the group consisting of a hydroxyl group, a hydroxyalkyl group, and a pyrolidonyl group; or a cationic leaving group, an anionic leaving group, and at least one group selected from the group consisting of a hydroxyl group, a hydroxyalkyl group, and a pyrolidonyl group.

Specific examples thereof include combinations of a pyrolidonyl group, a sulfone group, a carboxyl group, and a quaternary ammonium group. Other examples include combinations of a hydroxyethyl group, a sulfone group, a carboxyl group, and a quaternary ammonium group.

At least one group selected from the group consisting a hydroxyl group, a hydroxyalkyl group, and a pyrolidonyl group, and as necessary a cationic leaving group and/or an anionic leaving group can be introduced into the macromonomer by polymerizing the reactive monomers having the abovementioned groups so that the degree of polymerization becomes as mentioned above (10 to 100).

That is, the macromonomer can be generally prepared by polymerizing a mixed solution of the reactive monomers having these groups. As the polymerization method, for example an initiator polymerization method, a heat polymerization method, or an ionizing radiation polymerization method may be used. In this case, by suitably controlling the condition of reaction, the desired degree of polymerization can be obtained. If the ionizing radiation is used, ultraviolet rays, electron beams, X rays, $\alpha$ rays, $\beta$ rays, $\gamma$ rays, and the like can be used.

The obtained macromonomer comprises: reactive monomers having at least one group selected from the group consisting of a hydroxyl group, a hydroxyalkyl group, and a pyrolidonyl group; and as necessary, reactive monomers having a cationic leaving group and/or reactive monomers having an anionic leaving group. In this case, the blend mole ratio for preparing the macromonomer of: reactive monomers having at least one group selected from the group consisting of a hydroxyl group, a hydroxyalkyl group, and a pyrolidonyl group; reactive monomers having a cationic leaving group; and reactive monomers having an anionic leaving group, can be suitably selected according to the usage and performance of the graft polymer to be obtained.

For example, the macromonomer can be obtained by polymerizing a mixed solution including: 5 to 20 mole % of reactive monomers having at least one group selected from the group consisting of a hydroxyl group, a hydroxyalkyl group, and a pyrolidonyl group; 30 to 50 mole % of reactive monomers having a cationic leaving group; and 30 to 50 mole % of reactive monomers having an anionic leaving group.

The ordered state in the macromonomer of: reactive monomers having at least one group selected from the group consisting of a hydroxyl group, a hydroxyalkyl group, and a pyrolidonyl group; reactive monomers having a cationic leaving group; and reactive monomers having an anionic leaving group, is not specifically limited. Consequently, for example, reactive monomers having at least one group selected from the group consisting of a hydroxyl group, a hydroxyalkyl group, and a pyrolidonyl group; reactive monomers having a cationic leaving group; and reactive monomers having an anionic leaving group, may be arranged alternatively, arranged in a block form, arranged randomly, or arranged in a grafted form.

The ordered state depends on the condition of reaction when the macromonomer is produced, and the type of reactive monomer. The condition of reaction can be suitably selected by a person skilled in the art.

In the graft polymer according to the present invention, the macromonomer is chemically bonded with the resin matrix. As the bonding method, any publicly known method may be used. A graft polymerization method described later, in particular a radiation graft polymerization method using monosaccharides is preferably used. The usage of monosaccharides promotes the impregnation of the macromonomer into the resin matrix, enabling to remarkably increase the rate of graft polymerization of the macromonomer into the resin matrix.

Examples of the resin matrix as one capable of supporting the macromonomer, increasing the absorption area, and being bonded with the macromonomer, include at least one type selected from the group consisting of a cellulosic resin, a polyolefin resin, a polyacrylonitrile resin, a polyester resin, and a polyamide resin. For forming toner particles, a cellulosic resin and a polyamide resin are preferred, specific examples of which include; a methylcellulose resin, a hydroxypropylmethylcellulose resin, a hydroxypropylethylcellulose resin, Nylon 66, and 8 Nylon.

In the present invention, a solution including the abovementioned resin matrix is added with the mixture of the macromonomer and the monosaccharides so as to apply it to the resin matrix. The blend ratio of the macromonomer and the monosaccharides is not critical in the present invention, and can be suitably determined so as to obtain the desired rate of graft polymerization. For example, using the total mass of the macromonomer as the basis, 0.1 to 10 mass %, preferably 0.5 to 5 mass %, and more preferably 1 to 3 mass % of the monosaccharides is added.

After mixing the resin matrix solution and the mixture, they are graft polymerized. The graft polymerization method is not limited, and an initiator polymerization method, a heat polymerization method, an ionizing radiation polymerization method, and the like may be used. In the present invention, a graft polymerization method using irradiation of an ionizing radiation is preferably used. The employable ionizing radiation includes, for example ultraviolet rays, electron beams, X rays, α rays, β rays, γ rays, and the like. For practical purposes, γ rays or electron beams are desirably used. In the present invention, the rate of graft polymerization is not specifically limited, however 150% or less, and in particular 50% to 100%, is preferred.

The monosaccharides used for graft polymerization are aldose or ketose represented by the general formula of $C_nH_{2n}O_n$. In the formula, n represents an integer between 2 to 10. In the present invention, aldose is preferably used, and in particular glucose which is aldohexose of n=6 is preferably used.

In the present invention, by using activated carbon together with the graft polymer, the effect of the present invention can be further improved. In this case, as the employable activated carbon, a wood activated carbon having a specific surface area of 400 $m^2/g$ to 1300 $m^2/g$ is preferred. Using 0.01 to 1.2 parts by mass per 100 parts by mass of the graft polymer is preferred.

—Binder Resin—

The examples of the binder resin used in the present invention include: a polymer obtained by polymerizable monomers described below, a copolymer obtained by combining two types of the polymerizable monomers or more, or a combination thereof; furthermore an epoxy resin, a polyester resin, a polyurethane resin, a polyamide resin, a cellulose resin, a polyether resin and other non vinyl condensated resins; or a graft polymer obtained when polymerizing vinyl monomers in a mixture of these and the abovementioned vinyl resin, or in the presence of these.

The polymerizable monomer used in the present invention is not specifically limited. The employable examples include monomers and polymers such as: styrenes such as styrene, p-chlorostyrene, and α-methylstyrene; esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; vinylnitriles such as acrylonitrile, and methacrylonitrile; vinylethers such as vinylmethylether, and vinylisobutylether; vinylketones such as vinylmethylketone, vinylethylketone, and vinylisopropenylketone; and polyolefines such as ethylene, propylene, and butadiene. Furthermore, as a crosslinking constituent, for example, acrylic esters such as pentanediol diacrylate, hexanediol diacrylate, decanediol diacrylate, and nonanediol diacrylate may be used.

The abovementioned binder resin may be used as a binder resin particle dispersion liquid. The binder resin particle dispersion liquid may be produced, for example by emulsion polymerization or suspension polymerization using the abovementioned polymerizable monomers.

If a vinyl monomer is used as the polymerizable monomer, the binder resin particle dispersion liquid can be produced by performing emulsion polymerization or suspension polymerization, using an ionic surfactant or the like, according to the method of production.

Moreover, in the case of other binder resins, if the binder resin is oleaginous and soluble in a solvent having a relatively low water-solubility, then by dissolving the binder resin in such a solvent to disperse it as particles in water together with ionic surfactant and polyelectrolyte by a disperser such as a homogenizer, then evaporating the solvent by heating or pressure reduction, the binder resin particle dispersion liquid can be produced.

The particle diameter in the obtained binder resin particle dispersion liquid can be measured for example by a laser-diffraction grain size distribution measuring apparatus (LA-700 made by HORIBA Ltd.).

In the present invention, the graft polymer may function also as the binder resin.

—Colorant—

The colorant used in the present invention is not specifically limited, and a publicly known one may be used. Hereinafter, specific examples of such colorant are examplified.

Examples of black pigments include carbon black, cupric oxide, manganese dioxide, aniline black, activated carbon, non-magnetic ferrite, and magnetite.

Examples of yellow pigments include chrome yellow, zinc yellow, yellow iron oxide, cadmium yellow, fast yellow, fast yellow 5G, fast yellow 5GX, fast yellow 10G, benzidine yellow G, benzidine yellow GR, threne yellow, quinoline yellow lake, and permanent yellow NCG.

Examples of orange pigments include red chrome yellow, molybdenum orange, permanent orange GTR, pyrazolone orange, vulcan orange, benzidine orange G, indanthrene brilliant orange RK, and indanthrene brilliant orange GK.

Examples of red pigments include red iron oxide, cadmium red, red lead, cadmium mercury sulfide, Watchung red, permanent red 4R, lithol red, brilliant carmine 3B, brilliant carmine 6B, DuPont oil red, pyrazolone red, rhodamine lake B, lake red C, rose Bengal, eoxin red, and alizarin lake.

Examples of blue pigments include Prussian blue, cobalt blue, alkali blue lake, Victoria blue lake, fast sky blue, indanthrene blue BC, aniline blue, ultramarine blue, chalco oil blue, methylene blue chloride, phthalocyanine blue, phthalocyanine green, and malachite green oxalate.

Examples of purple pigments include manganese purple, fast violet B, and methyl violet lake.

Examples of green pigments include, chromium oxide, chrome green, pigment green, malachite green lake, and final yellow green G.

Examples of white pigment include zinc white, titanium oxide, antimony white, and zinc sulfide.

Examples of available extender pigments include powdery barytes, barium carbonate, clay, silica, white carbon, talc, alumina white, and the like.

Examples of dyes include various types of dyes such as basic dyes, acid dyes, disperse dyes, and direct dyes, for example nigrosine, methylene blue, rose Bengal, guinoline yellow, ultramarine blue. These colorants may be used alone or as a mixture, furthermore in the state of the solid solution. These colorants are dispersed by a publicly known method. For example preferably used are rotatary shear homogenizers, media assisted dispersing machines such as ball mills, sand mills, and attritors, as well as high pressure collision type dispersing machines.

Moreover, using surfactants having polarity, these colorants are dispersed into the water system by the homogenizer. The colorant of the present invention is selected from the viewpoint of hue angle, chroma, brightness, weather-resistance, OHP transparency, and dispersibility in the toner. The dosage of such colorant is suitably within a range of 1 to 20 parts by mass per 100 parts by mass of resin, and preferably 3 to 15 parts by mass. If magnetic substances are used for the black colorant substance, then unlike other colorants, the dosage is suitably within a range between 30 and 100 parts by mass, and preferably a range between 40 and 90 parts by mass.

Moreover, if the toner for developing electrostatic latent image of the present invention is used as a magnetic toner, it may contain magnetic powder. Substances that can be magnetized in the magnetic field are used for such magnetic powder, including ferromagnetic powder such as iron, cobalt, and nickel, or compounds of ferrite, magnetite, and the like. In particular, in the present invention, in order to obtain the toner in an aqueous phase, care should be taken of the aqueous phase transferability of the magnetic substance, and surface modification such as hydrophobing treatment is preferably applied.

The colorant dispersion liquid is obtained by dispersing colorants in an aqueous medium using for example an ultrasonic disperser or a high pressure collision type dispersing machine.

—Releasing Agent—

The employable releasing agent for the present invention is preferably a substance having the main maximum peak as measured according to ASTM D3418-8 within a range between 50 and 140° C. If it is lower than 50° C., offset tends to occur at the time of fixing. If it exceeds 140° C., the fixing temperature is increased, and the smoothness on the surface of the fixed image cannot be obtained, thus deteriorating the glossiness. A preferred range of the main maximum peak is between 80 and 115° C. The main maximum peak of the present invention was measured using Parkin Elmer's DSC-7. The temperature at a detecting portion of the measuring apparatus was corrected using the melting points of indium and zinc. The amount of heat was corrected using the heat of fusion of indium. The sample was measured at a heating rate of 10° C./min using an aluminium pan, with an empty pan set as a control.

Examples of the releasing agent used in the present invention include; low-molecular weight polyolefins such as polyethylene, polypropylene, and polybutene; silicones having a softening point under heat; fatty acid amides such as oleic acid amide, erucic acid amide, ricinolic acid amide, and stearic acid amide; vegetable waxes such as carnauba wax, rice wax, candelilla wax, Japan wax, and jojoba oil; animal waxes such as beewax; mineral or petroleum waxes such as montan wax, ozokerite, ceresin, paraffin wax, microcrystalline wax, and Fischer Tropsch wax; and modifications thereof. These waxes can be dispersed in water together with ionic surfactants and polyelectrolytes such as a polymer acid and polymer base, and made into particles by a homogenizer or a pressure discharging-type dispersing machine that can heat to the melting point or more, and apply a strong shearing force, enabling to produce a dispersion liquid of releasing agent particles having a diameter of 1 μm or less.

The particle diameter of the releasing agent particles in the releasing agent dispersion liquid was measured with a laser-diffractiometric particle size analyzer (HORIBA's LA-700). The content of the releasing agent in the toner is suitably within a range between 5 and 25 weight %. In a later paragraph, the production of the toner is described. In consideration of chargeability, durability, and releasability of the toner, the releasing agent is preferably added in the step for preparing core aggregated particles, and it is not suitable to add the releasing agent in the subsequent step for adding the additional particles.

The polarity of the releasing agent is preferably smaller than the polarity of the binder resin in terms of chargeability and durability. That is, the acid value of the mold releasing agent is preferably less than the acid value of the binder resin by 0.5 KOH equivalent or more, from the viewpoint of good containment. The acid value of the binder resin and the mold releasing agent can be obtained by KOH neutralization titration. 1 mol/L aqueous KOH solution, and a dispersion liquid of the binder resin or the mold releasing agent were prepared, and then the amount of KOH titration until neutralization was obtained using methyl orange or the like as an indicator. The acid value was expressed as an equivalent by dividing the titration amount by the molecular weight of KOH, which is 56.

The viscosity of the releasing agent at the temperature at a time of initiating of fixing the toner for developing electrostatic latent images of the present invention, for example 150° C., is preferably 30 m Pa·s. If it exceeds 30 m Pa·s, the leachability at the time of fixing is decreased, the releasability is worsened, and offset tends to occur.

—Other Components—

The toner for developing electrostatic latent images of the present invention may contain other components as necessary.

In the toner for developing electrostatic latent images of the present invention, charge control agents may be used for improving and stabilizing the chargeability. As such a charge control agent, various charge control agents that are normally used such as quaternary ammonium salt compounds, nigrosin compounds, dyes comprising complexes of aluminium, iron, chromium, and the like, triphenylmethane pigments, can be used. A material which is hardly dissolved in water is preferably used from the viewpoint of controllability of the ionic strength which affects the stability at the time of forming a toner due to aggergation or melting, and preventing wastewater pollution.

In the toner for developing electrostatic latent images of the present invention, inorganic particles may be added in a wet system for stabilizing the chargeability. As an example of inorganic particles to be added, those that are normally used as external additives for a toner surface such as silica, alumina, titania, calcium carbonate, magnesium carbonate, and tricalcium phosphate, can be used after dispensing with an ionic surfactant, a polymeric acid or a polymeric base.

Moreover, in order to impart fluidity and to improve the cleaning property of the toner for developing electrostatic latent image of the present invention, then similarly to a normal toner, after a step for drying the toner in a later described method of producing the toner for developing electrostatic latent images of the present invention, inorganic particles such as silica, alumina, titania, and calcium carbonate, or resin particles such as vinyl resin, polyester, and silicone may be added to the surface of the toner in a dry state under application of a shearing force.

The particle size of the toner for developing electrostatic latent images of the present invention is preferably between 3 to 9 μm, and more preferably between 3 to 8 μm. If the particle size is less than 3 μm, not only the producability becomes unstable, but also control of the internal domain structure becomes difficult and chargeability becomes insufficient, possibly decreasing developability. If it exceeds 9 μm, image resolution is decreased.

Moreover, regarding the particle diameter distribution index of the toner for developing electrostatic latent images of the present invention, the volume-average particle size distribution index GSDv is preferably 1.30 at most, and the ratio of the volume-average particle size distribution index GSDv to the number-average particle size distribution index GSDp is preferably 0.95 at least.

If the volume-average particle size distribution index GSDv of the toner exceeds 1.30, the resolution is decreased. If the ratio of the volume-average particle size distribution index GSDv to the number-average particle size distribution index GSDp is less than 0.95, the chargeability may be decreased, which causes image failure such as scattering of the toner and fogging.

The particle diameter and the particle diameter distribution index of the toner for developing electrostatic latent images can be defined in the following manner. Based on the particle size distribution measured by a Coulter Multisizer II measuring apparatus (made by Beckmann-Coulter), the volume and the number of particles are drawn from the small diameter side as an accumulated distribution corresponding to respective divided particle size ranges (channels). The particle diameter at an accumulation of 16% is designated as a volume D16% (D16v) and a number D16% (D16p), and the particle diameter at an accumulation of 50% is designated as a volume D50% (D50v) and a number D50% (D50p). Furthermore, the particle diameter at an accumulation of 84% is designated as a volume D84% (D84v) and a number D84% (D84p). By using these values, the volume-average particle size distribution index (GSDv) is obtained from $(D84v/D16v)^{0.5}$, and the number-average particle size distribution index (GSDP) is calculated from $(D84p/D16p)^{0.5}$.

The shape factor SF1 of the toner for developing electrostatic latent image of the present invention is suitably within a range between 100 to 130 from the viewpoint of the image forming property. The preferred range of the shape factor SF1 is between 110 to 120. The shape factor SF1 is obtained in the following manner. An optical micrograph of the toner scattered on a slide glass is imported into a LUZEX image analyzer through a video camera, and the peripheral length (ML) and the projected area (A) are measured for 50 or more toner particles. Then, $(ML^2/A)$ is calculated and the average value is obtained.

The toner for developing electrostatic latent images of the present invention preferably has a complex viscosity η* at 160° C. of the toner, obtained by temperature dispersion analysis of the toner in a sinusoidal oscillation method, within a range between $3.0\times10^2$ and $1.2\times10^3$ Pas, and a loss tangent tan δ thereof within a range between 0.6 to 1.8.

The toner within the above range is advantageous since even if it is fixed by a fixing unit of high-speed and low-pressure, the releasability of the fixed image does not become irregular due to the temperature, that is the temperature dependency of the releasability is low, there is no dependency of the amount of the toner on the image, the fixabirity such as the surface glossiness of the fixed image and the OHP transparency are superior, and the folding resistance of the fixed image is good.

If the complex viscosity η* is lower than $3.0\times10^2$ Pas, the aggregated force of the binder resin itself becomes lower, and offset tends to occur at high temperature. If it exceeds 1.2× 103 Pas, the aggregated force of the binder resin itself becomes too high, and the fixed image hardly has surface glossiness. The preferred range of the complex viscosity η* is between $3.5\times10^2$ and $1.0\times10^3$ Pas.

If the loss tangent tan δ is lower than 0.6, the storage elastic modulus that indicates the elasticity factor is increased, thus decreasing the surface glossiness of the fixed image. If it exceeds 1.8, the viscosity of the binder resin itself is increased, worsening the cowebbing resistance, which results in a decrease in the releasability in oilless fixation. The preferred range of the loss tangent tan δ is between 0.8 and 1.7.

The dynamic viscoelasticity is measured using the complex viscosity η* and the loss tangent tan δ obtained from temperature dispersion analysis in a sinusoidal oscillation method at a frequency of 6.28 rad/sec, by a Rheometric Scientific's ARES meter unit. The dynamic viscoelastometry is normally measured in the following method. The toner is formed into a tablet, then set on a parallel plate having a diameter of 25 mm. The normal force is set to 0, then sinusoidal oscillation is applied at a frequency of 6.28 rad/sec. The measurement is started from 140° C. and continued up to 180° C. The measurement is performed at intervals of 30 seconds, and the temperature is adjusted having an accuracy of ±1.0° C. or less after the measurement is started.

Moreover, during the measurement, the amount of strain was 0.5% at each measurement temperature.

Generally, the viscosity of the toner at the time of melting affects the spinnability. The spinnability is peculiar to polymers. As the spinnability is increased, the releasability at the time of oilless fixation is worsened. Moreover, the spinnability is affected by the weight average molecular weight Mw of the binder resin in the toner, the presence or absence of the crosslinking structure, the crosslink density thereof, and the like. The spinnability occurs in a particular range of elasticity and viscosity. If the elasticity is high and the crosslink density is high, the spinnability can be readily suppressed in a practical range of the fixing temperature. However in this case, the surface glossiness of the fixed image can not be obtained. The problem is serious particularly when an amorphous binder resin is used. Moreover, if the elasticity is low, the spinnability can be suppressed, and the glossiness of the image may be obtained. However, offset tends to occur at high temperature, and the practical use thereof is difficult.

Therefore, in order to satisfy releasability while obtaining sufficient glossiness of the fixed image at the time of oilless fixation, it is necessary to suppress the spinnability under low elasticity and low crosslink density, that is, to adjust the ratio of the elasticity to the viscosity while keeping an appropriate elasticity. The ratio of the elasticity to the viscosity needs to be controlled so that the complex viscosity η* obtained from the dynamic viscoelastometry is kept within a certain range, and the loss tangent tan δ=(loss elastic modulus/storage elastic modulus) is kept within a fixed range.

To control the complex viscosity η* and the loss tangent tan δ in the present invention, inorganic particles A having a mean particle diameter of 5 to 20 nm and inorganic particles B having a mean particle diameter of 30 to 100 nm are added and mixed within the range of the ratio (A/B) of the inorganic particles A to the inorganic particles B between 0.7 and 3.0, and within a range of the total addition between 0.5 and 10 mass % per toner.

The absolute value of the quantity of charge of the toner for developing electrostatic latent images of the present invention is preferably 15 to 60 μC/g, more preferably 20 to 50 μC/g, and even more preferably 20 to 35 μC/g. If the quantity of charge is lower than 15 μC/g, the background will be stained (fogged). If it exceeds 60 μC/g, the image density is readily lowered.

Moreover, the ratio of the quantity of charge of the toner for developing electrostatic latent images in summer (30° C., 85% RH) and the quantity of charge thereof in winter (10° C., 35% RH) is preferably within a range between 0.5 and 1.5. If the ratio becomes out of the range, the quantity of charge is more dependent on the environment and the charge stability becomes deficient. Therefore the toner is unfavorable for practical use.

<Method of Producing Toner for Developing Electrostatic Latent Images>

The toner for developing electrostatic latent images of the present invention can be produced by an aggregation coalescence method, a suspension polymerization method, a suspension of polymer/pigment solution and solvent removal method or a dissolution suspension method. Among them, the aggregation coalescence method is preferred.

—Aggregation Coalescence Method—

The aggregation coalescence method comprises: a aggregation step for mixing at least a binder resin particle dispersion liquid in which a binder resin having a particle diameter of 1 μm or less is dispersed, a colorant particle dispersion liquid in which colorant particles are dispersed, a releasing agent particle dispersion liquid in which releasing agent particles are dispersed, and graft polymer particles that have been made by graft polymerization of a resin matrix and a macromonomer including at least one group selected from the group consisting of a hydroxyl group, a hydroxyalkyl group, and a pyrolidonyl group, so as to form aggregated particles containing at least the binder resin particles and the colorant particles; and a fusion step for heating the aggregated particles to a temperature above the glass transition point or the melting point of the binder resin, so as to fuse and coalesce them.

In the case of the aggregation coalescence method, the binder resin particle dispersion liquid is generally produced by emulsion polymerization and the like. At the step of producing the binder resin particle dispersion liquid, binder resin particles may be prepared by mixing the polymerizable monomer and the graft polymer.

The aggregation coalescence method may have a resin particle dispersion liquid preparation step for obtaining a resin particle dispersion liquid including resin particles having a particle diameter of 1 μm or less, containing a binder resin, and a graft polymer that has been made by graft polymerization of a resin matrix and a macromonomer including at least one group selected from the group consisting of a hydroxyl group, a hydroxyalkyl group, and a pyrolidonyl group. In the present invention, the mixture of the graft polymer and the binder resin may be simply called a binder resin.

Using the resin dispersion liquid of the binder resin particles dispersed by the ionic surfactant, hetero-aggregation is generated by mixing a colorant dispersion liquid that has been dispersed by an ionic surfactant of the opposite polarity, a releasing agent dispersion liquid, and the like.

At the time of this hetero-aggregation, as a functional group having adsorptivity of the polar substance, the graft polymer may be further added and mixed.

Next, as necessary, the binder resin particles are added to adhere and aggregate onto the surface so as to form aggregated particles having the diameter of the toner particles. Then, by heating above the glass transition point or the melting point of the binder resin, the aggregated particles are made to fuse and coalesce, and the obtained product is then washed and dried. The shape of the toner particles is preferably from indeterminate to globular.

Moreover, even if the aggregation step is performed by mixing the binder resin particle dispersion liquid and the like at once to cohere, the aggregation step may be such that: in the beginning of the aggregation step, the balance of the amount of ionic dispersing agents of respective polarities is previously changed, then the toner is ionically neutralized using a polymer of for example inorganic metal salts such as calcium nitrate, or inorganic metal salts such as polyaluminium chloride, to form a first phase core aggregation below the glass transition point. Then, after stabilization, binder resin particles that have been treated with a dispersing agent of an amount and polarity to correct the unbalance are added as a second phase. Furthermore as necessary the mixture is stabilized at a higher temperature by slightly heating below the glass transition point of the binder resin contained in the core or the added binder resin particles, after which it is heated above the glass transition point, so that the binder resin particles that have been added at the second phase of cohesion formation are made to coalesce while being adhered to the surface of the core aggregated particle. Furthermore, the phasing operation of aggregattion may be performed repeatedly for a plurality of times.

—Suspension Polymerization Method—

The suspension polymerization method comprises: a dispersion step for dispersing at least a colorant, a releasing agent, a polymerization initiator, and a graft polymer that has been made by graft polymerization of a resin matrix and a macromonomer including at least one group selected from the group consisting of a hydroxyl group, a hydroxyalkyl group, and a pyrolidonyl group, in a polymerizable monomer so as to obtain a dispersion liquid; a suspension step for suspending the dispersion liquid in water so as to obtain a suspension liquid; and a polymerization step for heating the suspension liquid so as to polymerize the polymerizable monomer.

In the case of the suspension polymerization method, for example, a colorant, a releasing agent, a graft polymer, and a polymerization initiator are dispersed in the polymerizable monomer of styrene, acrylic ester, acrylic acid, and the like, which is then heated to 55° C. under the presence of an inert gas, so as to completely dissolve the mold releasing material. Then, it is added with a polymerization initiator such as azobisisobutylacrylate. Next, it is added into a water dispersion liquid of an inorganic dispersing agent such as calcium phosphate that has been preheated to 60° C., and mechanically sheared by a homogenizer such as a TK homomixer to suspend and granulate so as to obtain the dispersion liquid. It is then heated to a temperature above the 10 hour half-life temperature of the polymerization initiator, so that it reacts for 6 hours. After the reaction, it is cooled to the normal temperature. Then acid such as hydrochloric acid is added so as to remove the dispersing agent constituent by dissolving.

Then, it is washed with sufficient pure water. When the pH of the filtrate becomes neutral, it is separated into solid and liquid using a filter medium such as a paper filter No. 5A, so that the toner for developing electrostatic latent image can be obtained.

—Suspension of Polymer/Pigment Solution and Solvent Removal Method—

The suspension of polymer/pigment solution and solvent removal method comprises: a prepolymerization step for prepolymerizing the polymerizable monomer so as to obtain a polymeride having a weight average molecular weight (Mw) of 3000 to 15000 measured by gel permeation chromatography (GPC); a dispersion step for dispersing at least the polymeride, a polymerizable monomer, a polymerization initiator, a releasing agent, a colorant, and a graft polymer that has been made by graft polymerization of a resin matrix and a macromonomer including at least one group selected from the group consisting a hydroxyl group, a hydroxyalkyl group, and a pyrolidonyl group, in an organic solvent so as to obtain a dispersion liquid; a suspension step for suspending the dispersion liquid in water so as to obtain a suspension liquid; and a polymerization step for heating the suspension liquid so as to polymerize the polymeride and the polymerizable monomer.

In the case of the suspension of polymer/pigment solution and solvent removal method the polymerizable monomer is prepolymerized to produce a polymeride solution having a Mw of 3000 to 15000 by GPC measurement, which is then added with a graft polymer, a releasing agent, a colorant, a polymerizable monomer, and a polymerization initiator. It is then mechanically sheared to suspend under the presence of an inorganic or organic dispersing agent, and then applied with thermal energy while stirring and shearing, so that the polymeride particles can be obtained.

In this case, by setting the Mw of the polymeride obtained by prepolymerization to 3000 to 15000, not only a viscosity that is suitable for fixing and granulation can be obtained, but also the Mw of the produced toner for developing electrostatic latent image can be controlled without a chain transfer agent.

—Dissolution Suspension Method—

The dissolution suspension method comprises: a dissolving step for dissolving at least a binder resin, a colorant, a releasing agent, and a graft polymer that has been made by graft polymerization of a resin matrix and a macromonomer including at least one group selected from the group consisting of a hydroxyl group, a hydroxyalkyl group, and a pyrolidonyl group, in an organic solvent so as to obtain a dispersion liquid; a suspension step for suspending the dissolved liquid in water so as to obtain a suspension liquid; and a separation step for separating the suspension liquid into solid and liquid.

In the case of the dissolving and suspending method, a binder resin, a colorant, a graft polymer, and a releasing agent are once dissolved in an organic solvent such as ethyl acetate which is capable of dissolving them. Next, the solution is mechanically sheared by a homogenizer such as a TK homomixer to disperse in an aqueous solvent which is not capable of dissolving them, with inorganic particles such as calcium phosphate, or an organic dispersing agent such as polyvinyl alcohol or sodium polyacrylate. Next, it is added for example to 1 M hydrochloric solution so as to remove the dispersing agent constituent by dissolving, after which solid-liquid separation is performed for example by Nutsche filtration using a filter paper. Then, the solvent constituent remaining in the particle is removed, so that the toner for developing electrostatic latent images can be obtained.

After forming the toner for developing electrostatic latent images, as necessary the dispersing agent is removed by a strong acid such as hydrochloric acid, sulfuric acid, or nitric acid. Then the obtained toner is rinsed with ion-exchanged water until the filtrate becomes neutral. Considering the chargeability of the toner, it is preferably to sufficiently perform substitution washing with ion-exchanged water. Furthermore, through the optional washing step, solid-liquid separation step, and drying step, a desired toner for developing electrostatic latent images can be obtained.

The solid-liquid separation step is not specifically limited, however suction filtration, pressure filtration, and the like are preferably used from the viewpoint of productivity. Furthermore, the drying step is not specifically limited, however, freeze drying, flash jet drying, fluidized drying, oscillatory fluidized drying, and the like are preferably used from the viewpoint of productivity.

<Developer for Electrostatic Latent Images>

The developer for electrostatic latent images of the present invention contains at least the toner for developing electrostatic latent images of the present invention. The toner for developing electrostatic latent image of the present invention can be used as a one-component developer as it is. Moreover, it can be used as a toner in a two-component developer comprising a carrier and a toner. Since the electrostatic latent image developer of the present invention contains the toner for developing electrostatic latent image of the present invention, odor occurrence at the time of fixing the image can be suppressed.

Hereinafter, the two-component developer will be described in detail.

The carrier that can be used for the two-component developer is not specifically limited and a publicly known carrier may be used. Examples thereof include a resin coated carrier having a resin coated layer on the surface of the core material. Moreover, it may be a resin dispersion type carrier in which a conductive material and the like is dispersed in a matrix resin.

Examples of the coated resin/matrix resin used for the carrier include polyethylene, polypropylene, polystyrene, polyvinyl acetate, polyvinyl alcohol, polyvinyl butyral, polyvinyl chloride, polyvinylether, polyvinylketone, vinyl chloride-vinyl acetatecopolymeride, styrene-acrylic acid copolymeride, straight silicone resin comprising organosiloxane bond and the modification thereof, fluororesin, polyester, polycarbonate, phenol resin, and epoxy resin, however it is not limited to these.

Examples of the conductive material include metals such as gold, silver, and copper, carbon black, furthermore titanium oxide, zinc oxide, barium sulphate, aluminium borate, potassium titanate, tin oxide, and carbon black, however it is not limited to these.

Examples of the core material of the carrier include magnetic metal such as iron, nickel, and cobalt, or magnetic oxide such as ferrite, magnetite, and the like, and glass beads. However, a magnetic material is preferred in order to use the carrier in magnetic brushing.

The volume-average particle diameter of the core material of the carrier is generally 10 to 500 μm, and preferably 30 to 100 μm.

Moreover, in order to coat a resin on the surface of the core material of the carrier, there is a method of coating with a solution for forming a coating layer where the coated resin and as necessary various additives are dissolved in an appropriate solvent. The solvent is not specifically limited, and may be suitably selected considering the coated resin to be used, the suitability of coating it, and the like.

Specific examples of the resin coating method include: a soaking method for soaking the core material of the carrier in a solution for forming a coating layer; a spray method for spraying a solution for forming a coating layer onto the surface of the core material of the carrier; a fluid bed method for spraying a solution for forming a coating layer while the core material of the carrier is being floated by an air flow; and a kneader coater method for mixing the core material of the carrier and the solution for forming a coating layer, in a kneader coater and then removing the solvent.

The mixing ratio (mass ratio) of the toner for developing electrostatic latent image of the present invention, to the carrier in the two-component developer is preferably within a range between toner: carrier=1:100 and 30:100, and more preferably about a range between 3:100 and 20:100.

<Image Forming Method and Image Forming Apparatus>

The image forming method of the invention comprises: uniformly charging the surface of an image holding material; forming a latent image on the surface of the charged image holding material; developing the latent image that has been formed on the surface of the image holding material with a developer having at least a toner, so as to form a toner image; transferring the toner image that has been formed on the surface of the image holding material onto a transfer material; fixing the toner image that has been transferred onto the transfer material; and removing residual toner on the surface of the image holding material after the transferring, wherein the developer is the developer for electrostatic latent images of the present invention is used.

In the image forming method of the present invention, since the developer for electrostatic latent images of the present invention is used, odor generation in the fixing can be suppressed.

The fixing device used in the fixing can well exhibit its effect even if using a conventional fixing member in which a transfer material is passed between two thermal fixing rollers to fix the image thereon. However, the toner for developing electrostatic latent images of the present invention has superior surface smoothness compared to a conventional toner when employing a free belt nip fixing (FBNF) system comprising a thermal fixing roller and an endless belt.

The image forming apparatus of the invention comprises: an image holding material; a charging device which uniformly charges the image holding material; a latent image forming device which forms a latent image on a surface of the charged image holding material; a developing device which develops the latent image that has been formed on the surface of the image holding material with a developer having at least a toner, so as to form a toner image; a transferring device which transfers the toner image that has been formed on the surface of the image holding material onto a transfer material; a fixing device which fixes the toner image that has been transferred onto the transfer material; and a cleaning device which removes residual toner on the surface of the image holding material after the transferring, wherein the developer for electrostatic latent imagse of the present invention is used as the above developer.

As the fixing device, the fixing device in the FBNF system is preferably used.

Hereinafter, the fixing device in the FBNF system will be described in detail.

The fixing device in the FBNF system is a combination of a thermal fixing roller and an endless belt. The thermal fixing roller has a cylindrical core coated with a heat-resistant elastic layer, and the elastic layer is further coated with a heat-resistant resin layer. The endless belt is provided with a pressure member inside thereof, and forms a nip part where the endless belt coils around the thermal fixing roller at a predetermined angle. The pressure member presses the endless belt against the thermal fixing roller so that the heat-resistant elastic layer of the thermal fixing roller is distorted. Through the nip part between the thermal fixing roller and the endless belt, a recording sheet is made to pass so as to fix the toner image under heat and pressure.

Hereunder is a description of the image forming method of the present invention using the image forming apparatus of the present invention, with reference to the drawings. The same reference symbols are used in all drawings for members that have similar functions, and description thereof may be omitted.

FIG. 1 shows a first embodiment of the image forming apparatus of the present invention, comprising a fixing unit in the FBNF system as the fixing device.

The image forming apparatus 30 comprises a photoreceptor drum 1 around which a charger 2, an image-writing unit 3 such as laser, a development unit 4, a primary transfer unit 5, and a cleaning unit 6 are disposed sequentially in the rotation direction. Black, yellow, magenta and cyan toners are stored in development members $\mathbf{4}_1$ to $\mathbf{4}_4$ of the development unit 4. An intermediate transfer belt 7 is brought into contact with the surface of the photoreceptor drum 1, running between the photoreceptor drum 1 and the primary transfer unit 5 in the direction of the arrow. The belt 7 is held under tension by tension rolls 8*a*, 8*b*, and 8*c* and a backup roll 9. Opposite to the backup roll 9 and the tension roll 8*a*, are respectively disposed a bias roll 10 and a belt cleaner 11. The backup roll 9 is kept in contact with a voltage applying roll 12.

The area in which the primary transfer unit 5 is pressed against the photoreceptor drum 1 via the intermediate transfer belt 7 is a primary transfer zone, and the area in which the bias roll 10 is pressed against the backup roll 9 is a secondary transfer zone. The belt type fixing unit 14 comprises a pressure roll 15, a transfer belt 16, a pressure pad 17 which is to press the transfer belt 16 against the pressure roll 15, and a belt guide 18.

The surface of the photoreceptor drum 1 is uniformly charged by the charger 2, and a latent image is formed by the image-writing unit 3. The latent image that has been formed on the surface of the photoreceptor drum 1 is developed by a toner comprising a developer layer on the surface of the developer bearing member in the development unit 4 disposed opposite to the photoreceptor drum 1, so as to form the toner image. The toner image that has been formed on the surface of the photoreceptor drum 1 is electrostatically transferred onto the intermediate transfer belt 7 in the primary transfer zone. The toner image is transferred from the intermediate transfer belt 7 onto the transfer paper P fed from a paper tray 13, and the paper with the image is then conveyed into the fixing unit 14 comprising the pressure roll 15 with an internal heater and the transfer belt 16, so as to fix it. After the surface toner image has been transferred, residual toner is removed by the cleaning unit 6, from the photoreceptor drum 1.

Figure 2:
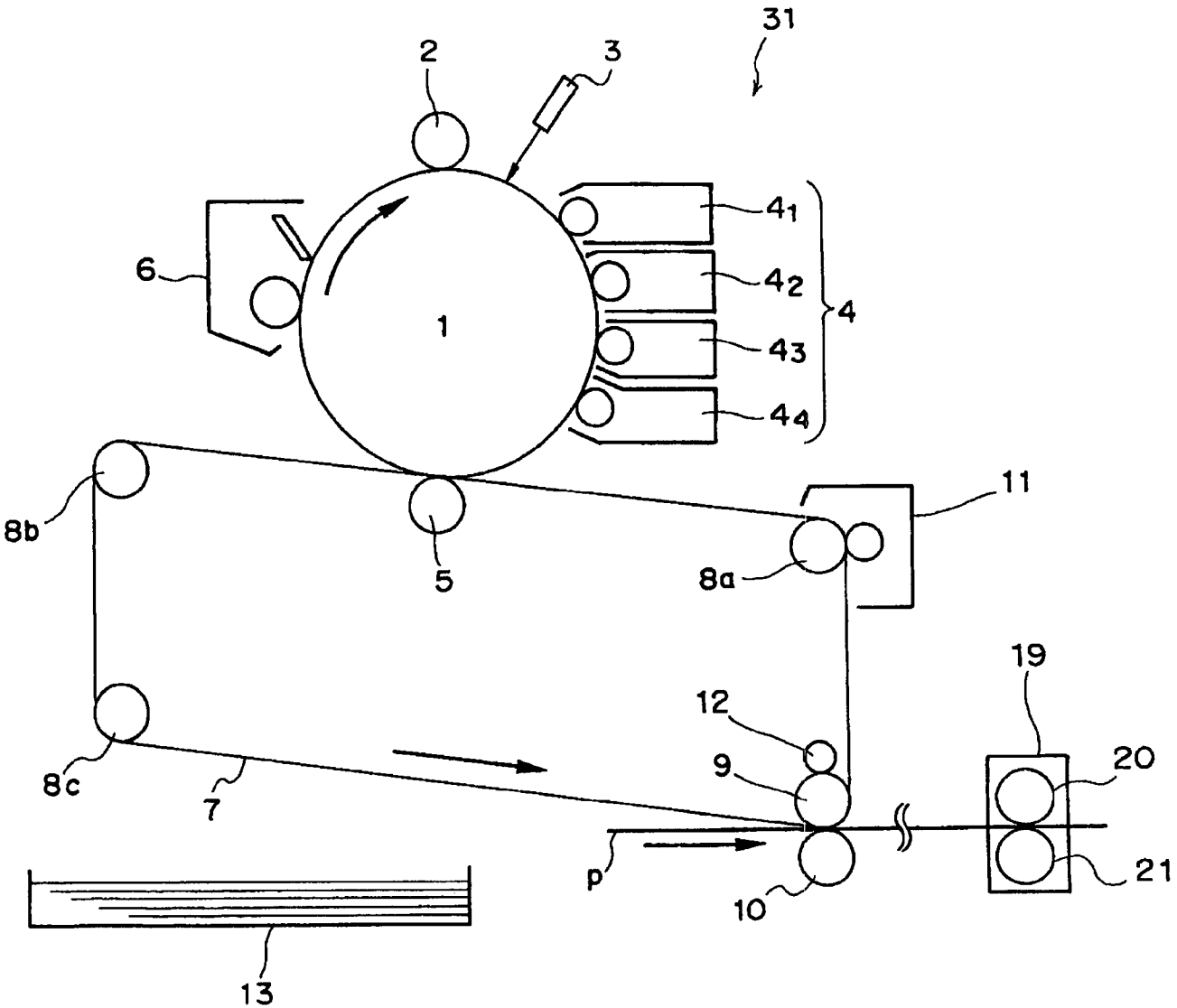
FIG. 2 shows a second embodiment of an image forming apparatus of the present invention.

FIG. 2 shows a second embodiment of the image forming apparatus of the present invention, wherein a roll type fixing unit is used as the fixing device. In the image forming apparatus 31, a roll type fixing unit 19 comprises a pressure roll 20 that is pressed against a fixing roll 21.

EXAMPLES

Hereunder is a detailed description of the invention with reference to examples, which, however, are not in any way intended to restrict the scope of the invention. Moreover, hereunder "part" and "%" represent a mass standard unless specifically described.

The toner for developing electrostatic latent images opf the present invention is obtained by the following method.

In the aggregation coalescence method, the binder resin particle dispersion liquid, the colorant dispersion liquid, the releasing agent dispersion liquid, and as necessary the inorganic particle dispersion liquid are respectively prepared. At this time, the graft polymer according to the present invention may be previously added and stirred into a predetermined amount of a part of an inorganic metal salt polymeride, to make them aggregate.

Next, while mixing and stirring a predetermined amount thereof, an inorganic metal salt polymeride is added to ionically neutralize it and form the aggregates of the above respective particles. The binder resin particle is further added before the desired toner particle diameter is achieved, and the toner particle diameter is obtained. Next, the pH in the system is adjusted from the weak acidic range to the neutral range by an inorganic hydroxide, then heated above the glass transition temperature of the binder resin, so as to coalesce and fuse. After the reaction, through a sufficient washing step, solid-liquid separation step, and drying step, a desired toner is obtained.

In the suspension polymerization method, the polymerizable monomer, the releasing agent, the colorant, and the graft polymer according to the present invention are heated and mixed. The mixture is then sheared by a media type disperser so as to perform the dispersion treatment. Then, it is added into a pure water dispersion liquid that has been adjusted by the inorganic dispersing agent together with the oil-soluble polymerization initiator dissolved in the polymerizable monomer, and is granuled by a homogenizer, and then heated so as to obtain the polymeride. Next, through a washing step, solid-liquid separation step, and drying step, a desired toner is obtained.

In the suspension of polymer/pigment solution and solvent removal method after prepolymerizing the polymerizable monomer, it is emulsified in the presence of a surfactant together with the graft polymer of the present invention by mechanical shearing force, and then heat polymerized in the presence of the water-soluble polymerization initiator, so as to obtain the emulsified resin particles. By using them, and thereafter operating similarly to the cohesion and coalescent method, the toner is obtained.

In the dissolution suspension method, the binder resin, the colorant, and the releasing agent are dissolved in an organic solvent, which is then added into a water system where the inorganic dispersing agent and the graft polymer according to the present invention are present, and mechanically sheared by a homogenizer and the like so as to suspend with the toner particle diameter particles. After cooling, by performing solid-liquid separation, followed by desolvation under a reduced-pressure atmosphere, a desired toner is obtained.

Hereunder are examples of the preparation method of respective materials, and the production method of toner particles.

<Preparation of Graft Polymer 1>

1000 parts of mixed aqueous solution including 300 parts of diethylaminoethyl methacrylate and 50 parts of hydroxyethyl methacrylate is put into a glass container, and the aqueous solution is bubbled with high purity nitrogen for 1 minute to replace the oxygen that has been dissolved in the aqueous solution. Next, the aqueous solution is irradiated with γ rays from cobalt 60 at a dosage rate of 0.1 kGy/hr for 1 hour at room temperature to prepare the macromonomer. The average degree of polymerization of the macromonomer is 85. 10 parts of glucose is added to the obtained macromonomer solution and sufficiently dissolved to obtain a mixed liquid. 50 parts of the obtained mixed liquid is added to a solution comprising: 25 parts of hydroxypropylmethyl cellulose (Metorose SH: made by Shin-Etsu Chemical); 5 parts of methanol; and 70 parts of water, and stirred at room temperature for 10 minutes, and then put into an irradiation container. The inside of the irradiation container is deoxidized, then irradiated with γ rays from cobalt 60 at a dosage rate of 10 Gy/hr for 2.5 hours at room temperature to obtain the graft polymer 1.

<Preparation of Graft Polymer 2>

1000 parts of mixed aqueous solution including 300 parts of dimethylaminoethyl methacrylate and 100 parts of vinylpyrrolidone is put into a glass container, and the aqueous solution is bubbled with high purity nitrogen for 1 minute to replace the oxygen that has been dissolved in the aqueous solution. Next, the aqueous solution is polymerized by irradiating with γ rays from cobalt 60 at a dosage rate of 0.5 kGy/hr for 1 hour at room temperature to prepare the macromonomer. The average degree of polymerization of the macromonomer is 90. A 1% amount of glucose with respect to the total macromonomer amount is added to the obtained macromonomer solution and sufficiently dissolved to obtain a mixed liquid. 50 parts of the obtained mixed liquid is added to a solution comprising: 25 parts of hydroxypropylmethyl cellulose (Metorose SH: made by Shin-Etsu Chemical); 5 parts of methanol; and 70 parts of water, and stirred at room temperature for 10 minutes, and then put into an irradiation container. The inside of the irradiation container is deoxidized, then irradiated with γ rays from cobalt 60 at a dosage rate of 10 Gy/hr for 2.0 hours at room temperature to obtain the graft polymer 2.

<Preparation of Graft Polymer 3>

100 parts of mixed aqueous solution including 30 parts of dimethylaminoethyl methacrylate and 10 parts of triethyleneglycol diacrylate is put into a glass container, and the aqueous solution is bubbled with high purity nitrogen for 1 minute to replace the oxygen that has been dissolved in the aqueous solution. Next, the aqueous solution is polymerized by irradiating with γrays from cobalt 60 at a dosage rate of 1.0 kGy/hr for 1 hour at room temperature to prepare the macromonomer. The average degree of polymerization of the macromonomer is 100. A 5% amount of glucose with respect to the total macromonomer amount is added to the obtained macromonomer solution and sufficiently dissolved to obtain a mixed liquid. 50 parts of the obtained mixed liquid is added to a solution comprising: 25 parts of hydroxypropylmethyl cellulose (Metorose SH: made by Shin-Etsu Chemical); 5 parts of methanol; and 70 parts of water, and stirred at room temperature for 10 minutes, and then put into an irradiation container. The inside of the irradiation container is deoxidized, then irradiated with γ rays from cobalt 60 at a dosage rate of 10 Gy/hr for 2.5 hours at room temperature to obtain the graft polymer 3.

<Preparation of Graft Polymer 4>

100 parts of mixed aqueous solution including 10 parts of sodium styrenesulfonate, 10 parts of acrylic acid, and 10 parts of vinylpyrrolidone is put into a glass container, and the aqueous solution is bubbled with high purity nitrogen for 1 minute to replace the oxygen that has been dissolved in the aqueous solution. Next, the aqueous solution is polymerized by irradiating with 200 watts of ultraviolet rays at 40° C. for 1 hour to prepare the macromonomer. The average degree of polymerization of the macromonomer is 80. 10 parts of glucose is added to the obtained macromonomer solution and sufficiently dissolved to obtain a mixed liquid. 55 parts of the obtained mixed liquid is added to a solution comprising: 20 parts of type 8 nylon (Toresin F30, manufactured by Toray Industries, Inc.); 56 parts of methanol; and 24 parts of water, and stirred at room temperature for 10 minutes, and then put into an irradiation container. The inside of the irradiation container is deoxidized, then irradiated with γ rays from cobalt 60 at a dosage rate of 10 Gy/hr for 2.5 hours at room temperature to obtain the graft polymer 4.

<Preparation of Graft Polymer 5>

100 parts of mixed aqueous solution including 30 parts of vinylbenzyltrimethyl ammonium salt and 30 parts of acrylic acid is put into a glass container, and the aqueous solution is bubbled with high purity nitrogen for 1 minute to replace the oxygen that has been dissolved in the aqueous solution. Next, the aqueous solution is polymerized by irradiating with γ rays from cobalt 60 at a dosage rate of 0.1 kGy/hr for 1 hour at room temperature to prepare the macromonomer. The average degree of polymerization of the macromonomer is 95. A 5% amount of glucose with respect to the total macromonomer amount is added to the obtained macromonomer solution and sufficiently dissolved to obtain a mixed liquid. 55 parts of the obtained mixed liquid is added to a solution comprising: 20 parts of type 8 nylon (Tresin F30, manufactured by Toray Industries, Inc.); 56 parts of methanol; and 24 parts of water, and then put into an irradiation container. The inside of the irradiation container is deoxidized, then irradiated with γ rays from cobalt 60 at a dosage rate of 10 Gy/hr for 2 hours at room temperature to obtain the graft polymer 5.

<Preparation of Binder Resin Particle Dispersion Liquid 1>

Styrene (manufactured by Wako Pure Chemical Industries, Ltd.): 325 parts n-butylacrylate (manufactured by Wako Pure Chemical Industries, Ltd.): 75 parts β-carboxyethyl acrylate (manufactured by Rhodia Nicca): 9 parts Graft polymer 1: 0.8 parts Wood activated carbon: 0.2 parts 1,10decanediol diacrylate (manufactured by Shin-nakamura Chemical Co. Ltd.): 1.5 parts Dodecanethiol (manufactured by Wako Pure Chemical Industries, Ltd.): 2.7 parts The above ingredients are premixed and dissolved to prepare a solution. A surfactant solution having 4 parts of anionic surfactant (Dowfax A211, manufactured by The Dow Chemical Company) dissolved in 550 parts of ion-exchanged water is put into a flask, and added with 413.2 parts of the above solution, which is then dispersed and emulsified. While gently stirring and mixing it for 10 minutes, it is added with 50 parts of ion-exchanged water having 6 parts of ammonium persulfate dissolved. Next, the inside system is sufficiently replaced with nitrogen. Then while stirring the flask it is heated up in an oil bath until the inside system reached 70° C. In that condition, the emulsion polymerization is continued for 5 hours to obtain the binder resin particle dispersion liquid 1. The resin particles are separated from the binder resin particle dispersion liquid 1, and analyzed for their physical properties. The mean diameter is 195 nm, the solid content of the dispersion liquid is 42%, the glass transition point is 51.5° C., and the weight-average molecular weight Mw is 32000.

<Preparation of Binder Resin Particle Dispersion Liquid 2>

Styrene (manufactured by Wako Pure Chemical Industries, Ltd.): 325 parts n-butylacrylate (manufactured by Wako Pure Chemical Industries, Ltd.): 75 parts β carboxyethyl acrylate (manufactured by Rhodia Nicca): 9 parts Graft polymer 2: 0.5 parts 1,10decanediol diacrylate (manufactured by Shin-nakamura Chemical Co. Ltd.): 1.5 parts Dodecanethiol (manufactured by Wako Pure Chemical Industries, Ltd.): 2.7 parts The above ingredients are premixed and dissolved to prepare a solution. A surfactant solution having 4 parts of anionic surfactant (Dowfax A211, maufacured by The Dow Chemical Company) dissolved in 550 parts of ion-exchanged water is put into a flask, and added with 413.2 parts of the above solution, which is then dispersed and emulsified. While gently stirring and mixing it for 10 minutes, it is added with 50 parts of ion-exchanged water having 6 parts of ammonium persulfate dissolved. Next, the inside system is sufficiently replaced with nitrogen. Then while stirring the flask it is heated up in an oil bath until the inside system reached 70° C. In that condition, the emulsion polymerization is continued for 5 hours to obtain the binder resin particle dispersion liquid 2. The resin particles are separated from the binder resin particle dispersion liquid 2, and analyzed for their physical properties. The mean diameter is 217 nm, the solid content of the dispersion liquid is 42%, the glass transition point is 51.3° C., and the weight-average molecular weight Mw is 31500.

<Preparation of Binder Resin Particle Dispersion Liquid 3>

Styrene (manufactured by Wako Pure Chemical Industries, Ltd.): 325 parts n-butylacrylate (manufactured by Wako Pure Chemical Industries, Ltd.): 75 parts β-carboxyethyl acrylate (manufactured by Rhodia Nicca): 9 parts Graft polymer 3: 0.7 parts 1,10 decanediol diacrylate (manufactured by Shin-nakamura Chemical Co. Ltd.): 1.5 parts Dodecanethiol (manufactured by Wako Pure Chemical Industries, Ltd.): 2.7 parts The above ingredients are premixed and dissolved to prepare a solution. A surfactant solution having 4 parts of anionic surfactant (Dowfax A211, maufacured by The Dow Chemical Company) dissolved in 550 parts of ion-exchanged water is put into a flask, and added with 413.2 parts of the above solution, which is then dispersed and emulsified. While gently stirring and mixing it for 10 minutes, it is added with 50 parts of ion-exchanged water having 6 parts of ammonium persulfate dissolved. Next, the inside system is sufficiently replaced with nitrogen. Then while stirring the flask it is heated up in an oil bath until the inside system reached 70° C. In that condition, the emulsion polymerization is continued for 5 hours to obtain the binder resin particle dispersion liquid 3. The resin particles are separated from the binder resin particle dispersion liquid 3, and analyzed for their physical properties. The mean diameter is 208 nm, the solid content of the dispersion liquid is 42%, the glass transition point is 51.1° C., and the weight-average molecular weight Mw is 32000.

<Preparation of Colorant Dispersion Liquid 1>

Carbon black (R330 manufactured by Cabot Corporation): 45 parts

Ionic surfactant Neogen SC (manufactured by Dai-ichi Pharmaceutical Co., Ltd.): 5 parts Ion-exchanged water: 200 parts The abovementioned ingredients are mixed and dissolved, and then dispersed by a homogenizer (Ultra-Turrax, manufactured by IKA) for 10 minutes. Next, using an ultrasonic disperser, ultrasonic waves of 28 kHz are irradiated for 10 minutes to obtain the colorant dispersion liquid 1 having a mean particle diameter of 85 nm.

<Preparation of Colorant Dispersion Liquid 2>

Cyan Pigment (Copper Phthalocyanine B15:3 manufactured by Dainichiseika Color & Chemicals Mfg. Co., Ltd.): 45 parts Nonionic surfactant (Nonipol 400, manufactured by Sanyo Chemical Industries, Ltd.): 5 parts Ion-exchanged water: 200 parts The abovementioned ingredients are mixed and dissolved, and then dispersed by a homogenizer (Ultra-Turrax, manufactured by IKA) for 10 minutes, to obtain the colorant dispersion liquid 2 having a mean particle diameter of 168 nm.

<Preparation of Colorant Dispersion Liquid 3>

Yellow Pigment (PY74, manufactured by Clariant): 45 parts

Nonionic surfactant (Nonipol 400, manufactured by Sanyo Chemical Industries, Ltd.): 5 parts Ion-exchanged water: 200 parts The abovementioned ingredients are mixed and dissolved, and then dispersed by a homogenizer (Ultra-Turrax, manufactured by IKA) for 10 minutes, to obtain the colorant dispersion liquid 3 having a mean particle diameter of 148 nm.

<Preparation of Colorant Dispersion Liquid 4>

Magenta Pigment (R122, manufactured by Dainichi Seika Ltd.): 45 parts

Nonionic surfactant (Nonipol 400, manufactured by Sanyo Chemical Ltd.): 5 parts

Ion-exchanged water: 200 parts

The abovementioned ingredients are mixed and dissolved, and then dispersed by a homogenizer (Ultra-Turrax, manufactured by IKA) for 10 minutes, to obtain the colorant dispersion liquid 4 having a mean particle diameter of 176 nm.

<Preparation of Releasing Agent Dispersion Liquid>

Polyethylene Wax (PW725, manufactured by Toyo-Petrolite Co,. Ltd.: melting point of 103° C.): 45 parts Cationic surfactant (Neogen RK, manufactured by Dai-Ichi Kogyo Seiyaku Co., Ltd.): 5 parts Ion-exchanged water: 200 parts The above ingredients are heated to 95° C., and sufficiently dispersed by a homogenizer (Ultra-Turrax T50, manufactured by IKA), and then further dispersed in a pressure-jet Gaulin homogenizer to obtain the releasing agent dispersion liquid. The mean diameter of the releasing agent particles in the dispersion liquid is 186 nm, and the solid content is 21.5%.

<Production of Toner for Developing Electrostatic Latent Images 1>

Binder resin particle dispersion liquid 1: 80 parts

Colorant dispersion liquid 1: 45 parts

Inorganic particle dispersion liquid (Snowtex OL, manufactured by NISSAN CHEMICAL INDUSTRIES, LTD.): 5 parts Inorganic particle dispersion liquid (Snowtex OS, manufactured by NISSAN CHEMICAL INDUSTRIES, LTD.): 6.5 parts Releasing agent dispersion liquid: 40 parts Polyaluminium chloride (manufactured by Asada Chemical Co., Ltd.): 0.41 parts 178.41 parts of the above ingredients are sufficiently mixed and dispersed by a homogenizer (Ultra-Turrax T50, manufactured by IKA) in a round-bottomed stainless flask. Then, while stirring the flask in a heating oil bath, it is heated up to 47° C., and then kept at 47° C. for 60 minutes to prepare aggregated particle dispersion liquid. The aggregated particle dispersion liquid is gently added with 31 parts of the binder resin particle dispersion liquid 1.

Then, 0.5 mols/liter of an aqueous solution of sodium hydroxide is added so as to adjust the pH in the system to 5.4, after which the flask is sealed. While continuing stirring using a magnetic seal, it is heated up to 96° C. and kept for 5 hours. After the reaction, it is cooled, filtered, sufficiently ished with ion-exchanged water, and then subjected to solid-liquid separation by Nutsche suction filtration. It is further re-dispersed in 3 liters of ion-exchanged water at 40° C., and stirred for 15 minutes at 300 rpm and ished. The operation is repeated a further 5 times. When its filtrate had come to have a pH of 7.01, an electric conductivity of 9.8 μS/cm, and a surface tension of 71.1 Nm, solid-liquid separation is performed by Nutsche suction filtration using a paper filter No. 5A, and then vacuum drying is continued for 12 hours to obtain the toner for developing electrostatic latent images 1.

Regarding the particle diameter of the toner for developing electrostatic latent image 1, the volume-average diameter D50 is 5.4 μm, and the volume-average particle size distribution index GSDv is 1.21. The shape of the particles is observed with the LUZEX [image analyzer], which showed that the shape factor SF1 is 133.3, and they are in a potato shape. The complex viscosity $\eta^*$ at 160° C. of the toner particles, obtained through dynamic viscoelastometry, is $4.4\times 10^2$ Pas, and the loss tangent tan δ thereof is 1.32.

<Production of Toner for Developing Electrostatic Latent Images 2>

Binder resin particle dispersion liquid 1: 80 parts

Colorant dispersion liquid 2: 40 parts

Inorganic particle dispersion liquid (Snowtex OL, manufactured by NISSAN CHEMICAL INDUSTRIES, LTD.): 6.5 parts Inorganic particle dispersion liquid (Snowtex OS, NISSAN CHEMICAL INDUSTRIES, LTD.): 6.5 parts Releasing agent dispersion liquid: 40 parts Polyaluminium chloride (manufactured by Asada Chemical Co., Ltd.): 0.41 parts 178.41 parts of the above ingredients are sufficiently mixed and dispersed by a homogenizer (Ultra-Turrax T50, manufactured by IKA) in a round-bottomed stainless flask. Then, while stirring the flask in a heating oil bath, it is heated up to 47° C., and then kept at 47° C. for 60 minutes to prepare an aggregated particle dispersion liquid. The aggregated particle dispersion liquid is gently added with 31 parts of the binder resin particle dispersion liquid 1.

Then, 0.5 mols/liter of an aqueous solution of sodium hydroxide is added so as to adjust the pH in the system to 5.4, after which the flask is sealed. While continuing stirring using a magnetic seal, it is heated up to 96° C. and kept for 5 hours. After the reaction, it is cooled, filtered, sufficiently ished with ion-exchanged water, and then subjected to solid-liquid separation by Nutsche suction filtration. It is further re-dispersed in 3 liters of ion-exchanged water at 40° C., and stirred for 15 minutes at 300 rpm and washed. The operation is repeated a further 5 times. When its filtrate had come to have a pH of 7.01, an electric conductivity of 9.8 μS/cm, and a surface tension of 71.1 Nm, solid-liquid separation is performed by Nutsche suction filtration using a paper filter No. 5A, and then vacuum drying is continued for 12 hours to obtain the toner for developing electrostatic latent images 2.

Regarding the particle diameter of the toner for developing electrostatic latent image 2, the volume-average diameter D50 is 5.6 μm, and the volume-average particle size distribution index GSDv is 1.20. The shape of the particles is observed with the LUZEX [image analyzer], which showed that the shape factor SF1 is 133.0, and they are in a potato shape.

<Production of Toner for Developing Electrostatic Latent Images 3>

Except for using the binder resin particle dispersion liquid 3 instead of the binder resin particle dispersion liquid 1, and the colorant dispersion liquid 3 instead of the colorant dispersion liquid 2, a similar operation to the production of the toner for developing electrostatic latent image 2 is performed to obtain the toner for developing electrostatic latent image 3.

Regarding the particle diameter of the toner for developing electrostatic latent image 3, the volume-average diameter D50 is 5.6 μm, and the volume-average particle size distribution index GSDv is 1.23. The shape of the particles is observed with the LUZEX [image analyzer], which showed that the shape factor SF1 is 134.0 and they are in a potato shape.

<Production of Toner for Developing Electrostatic Latent Images 4>

Except for using the binder resin particle dispersion liquid 2 instead of the binder resin particle dispersion liquid 1, and the colorant dispersion liquid 4 instead of the colorant dispersion liquid 2, a similar operation to the production of the toner for developing electrostatic latent image 2 is performed to obtain the toner for developing electrostatic latent images 4.

Regarding the particle diameter of the toner for developing electrostatic latent image 4, the volume-average diameter D50 is 5.7 μm, and the volume-average particle size distribution index GSDv is 1.21. The shape of the particles is observed with the LUZEX [image analyzer], which showed that the shape factor SF1 is 133.5 and they are in a potato shape.

<Production of Toner for Developing Electrostatic Latent Images 5>

75 parts of styrene (manufactured by Wako Pure Chemical Industries, Ltd.) is added to 30 parts of polyethylene wax Polywax 500 (melting point of 85° C., manufactured by T Toyo-Petrolite Co,. Ltd) which has been preheated to 60° C., and is then heated for 10 minutes and dissolved. Next, it is added with 5 parts of cyan pigment (Copper Phthalocyanine B15:3, manufactured by Dainichiseika Color & Chemicals Mfg. Co., Ltd.) and 1 part of the graft polymer 4, and dispersed by a media type disperser at 60° C. for 2 hours. After discharging, it is cooled to obtain a colorant dispersion wax.

Next, the obtained colorant dispersion wax is added to a mixture of: 200 parts of styrene (manufactured by Wako Pure Chemical Industries, Ltd.); 75 parts of n butylacrylate (manufactured by Wako Pure Chemical Industries, Ltd.); 9 parts of β carboxyethyl acrylate (manufactured by Rhodia Nicca); 1.5 parts of 1,10decanediol diacrylate (manufactured by Shin-nakamura Chemical Co. Ltd.); and 2.7 parts of dodecanethiol (manufactured by Wako Pure Chemical Industries, Ltd.), then stirred at 60° C. for 15 minutes. Then, it is added with 50 parts of styrene which has been added with 24.5 parts of azobisisobutyronitrile (manufactured by Wako Pure Chemical Industries, Ltd.), and strongly stirred for 1 minute to obtain the dispersion liquid.

Next, in a 3 L flask, 2000 parts of pure water is added with 35 parts of calcium phosphate (manufactured by Wako Pure Chemical Industries, Ltd.) and dispersed by a homogenizer (Ultra-Turrax, manufactured by IKA) at 58° C. for 15 minutes, which is then added with the total amount of the dispersion liquid and granulated for 5 minutes. Then, while quickly replacing with nitrogen, the inside of the reaction system is kept at 75° C., and reaction is performed for 8 hours to obtain suspension particles having a particle diameter of 6.1 μm.

Then, it is cooled to room temperature and added with 1N HCl so as to remove the calcium phosphate by dissolving, and solid-liquid separation is performed using a paper filter No. 5A. Next, filtration using an ion-exchanged water is repeated until the filtrate showed neutrality. After the solid-liquid separation, it is dried to obtain the toner for developing electrostatic latent image 5. The volume-average diameter D50 of the toner for developing electrostatic latent image 5 is 6.4 μm, and the particle size distribution index GSDv thereof is 1.22. The shape of the particles is observed with the LUZEX [image analyzer], which showed that the shape factor SF1 is 117.2 and they are in a globular shape.

The storage elastic modulus G1' at 180° C. and a frequency of 6.28 rad/s of the toner for developing electrostatic latent image 5, obtained through dynamic viscoelastometry, is 2.74 $Pa/cm^2$, and the ratio to the storage elastic modulus G2' at a frequency of 62.8 rad/s is 1.7.

<Production of Toner for Developing Electrostatic Latent Images 6>

40 parts of styrene (manufactured by Wako Pure Chemical Industries, Ltd.), 15 parts of n-butylacrylate (manufactured by Wako Pure Chemical Industries, Ltd.), and 0.05 parts of azobisisobutyronitrile (manufactured by Wako Pure Chemical Industries, Ltd.) are heated at 70° C. for 40 minutes while introducing nitrogen, to perform prepolymerization. The Mw of the polymer obtained by dropping. one part of the obtained solution into about 5 times of methanol is 7000 by GPC measurement.

The following colorant dispersion wax is added to the obtained solution. The colorant dispersion wax is obtained by the following manner. 35 parts of styrene (manufactured by Wako Pure Chemical) is added to 30 parts of polyethylene wax Polywax 500 (melting point of 85° C., manufactured by Toyo Petrolite) which has been preheated to 60° C., and this is then heated for 10 minutes and dissolved. Next it is added with 5 parts of cyan pigment (Copper Phthalocyanine B15:3 manufactured by Dainichiseika Color & Chemicals Mfg. Co., Ltd.) and 1 part of the graft polymer 5, and dispersed by a media type disperser at 60° C. for 2 hours, and then discharging and cooling is carried out to obtain the colorant dispersion wax.

The obtained solution to which the colorant dispersion wax is added is added to a mixture of: 200 parts of styrene (manufactured by Wako Pure Chemical Industries, Ltd.); 75 parts of n butylacrylate (manufactured by Wako Pure Chemical Industries, Ltd.); 9 parts of β carboxyethyl acrylate (manufactured by Rhodia Nicca); 1.5 parts of 1,10decanediol diacrylate (manufactured by Shin-nakamura Chemical Co. Ltd.); and 2.7 parts of dodecanethiol (manufactured by Wako Pure Chemical Industries, Ltd.), then stirred at 60° C. for 15 minutes. Then, it is added with 50 parts of styrene which has been added with 24.5 parts of azobisisobutyronitrile (manufactured by Wako Pure Chemical Industries, Ltd.), and strongly stirred for 1 minute to obtain the dispersion liquid.

Next, in a 3 L flask, 2000 parts of pure water is added with 35 parts of calcium phosphate (manufactured by Wako Pure Chemical Industries, Ltd.) and dispersed by a homogenizer (Turrax, manufactured by IKA) at 58° C. for 15 minutes, which is then added with the total amount of the dispersion liquid and granulated for 5 minutes. Then, while quickly replacing with nitrogen, the inside of the reaction system is kept at 75° C., and reaction is performed for 8 hours to obtain suspension particles having a particle diameter of 6.1 μm.

Then, it is cooled to room temperature and added with 1N HCl so as to remove the calcium phosphate by dissolving, and solid-liquid separation is performed using a paper filter No. 5A. After the solid-liquid separation, it is dried to obtain the toner for developing electrostatic latent image 6. The volume-average diameter D50 of the toner for developing electrostatic latent image 6 is 6.3 μm, and the particle size distribution index GSDv thereof is 1.26. The shape of the particles is observed with the LUZEX [image analyzer], which showed that the shape factor SF1 is 118.4 and they are in a globular shape.

The storage elastic modulus G1' at 180° C. and a frequency of 6.28 rad/s of the toner for developing electrostatic latent image 6, obtained through dynamic viscoelastometry, is 2.74 $Pa/cm^2$, and the ratio to the storage elastic modulus G2' at a frequency of 62.8 rad/s is 1.8.

<Preparation of Toner Resin 1>

Into a reactor with a cooling tube, a stirrer, and a nitrogen introducer, is added 700 parts of bisphenol A ethylene oxide 2 mole adduct, 260 parts of isophthalic acid, and 2.1 parts of dibutyl tinoxide. The mixture is brought into reaction under a normal pressure at 25° C. for 7.5 hours, and is then brought into further reaction under reduced-pressure of 10 to 15 mmHg for 5 hours. Then, it is cooled down to 160° C., added with 18 parts of phthalic anhydride, and brought into reaction for 2 hours. Next, it is cooled down to 80° C., and brought into reaction with 191 parts of isophorone diisocyanate in ethyl acetate for 2 hours, so as to obtain an isocyanate containing resin 1. Next, 268 parts of the isocyanate containing resin 1 and 14 parts of isophorone diamine are reacted at 50° C. for 2 hours, so as to obtain a urea-denatured polyester 1.

Similarly to the above, 700 parts of bisphenol A ethylene oxide 2 mole adduct and 260 parts of terephthalic acid are condensed under a normal pressure at 230° C. for 8 hours. Next, the pressure is reduced to 10 mmHg under which it is brought into reaction for 5 hours, so as to obtain the polyester resin 2. 50 parts of urea-denatured polyester 1 and 450 parts of polyester resin 2 are dissolved and mixed into 900 parts of ethyl acetate to obtain an ethyl acetate solution of the toner resin 1. This is partially dried under reduced-pressure to isolate the toner resin 1.

<Production of Toner for Developing Electrostatic Latent Images 7>

200 parts of ethyl acetate solution of the toner resin 1 (solid content 38%), 15 parts of polyalkylene Wax HNP51 (melting point 77° C., manufactured by Nippon Seiro), 4 parts of cyan pigment (Copper Phthalocyanine B15:3 manufactured by Dainichi Seika), and 1 part of lauric acid hydrazide, are put into a beaker, and stirred by a homogenizer (Ultra-Turrax, manufactured by IKA) at 70° C. at 7800 rpm, so as to uniformly dissolve and disperse. The mixture is then added with 250 parts of ion-exchanged water and 0.2 parts of sodium dodecylbenzenesulfonate and uniformly dissolved, then heated up to 70° C. and stirred by a homogenizer (Ultra-Turrax, manufactured by IKA) at 7800 rpm. 500 parts of the obtained suspension liquid is transferred into a flask with a thermometer, and then stirred at 45° C. for 1 hour under reduced-pressure so as to remove the solvent. Next, filtration separation, ishing with an ion-exchanged water, and drying are performed, so as to obtain the toner for developing electrostatic latent images 7.

Regarding the particle diameter of the toner for developing electrostatic latent image 7, the volume-average diameter D50 is 5.8 μm, and the volume-average particle size distribution index GSDv is 1.24. The shape of the particles is observed with the LUZEX [image analyzer], which showed that the shape factor SF1 is 117.3 and they are in a globular shape. The complex viscosity $\eta^*$ at 160° C. of the toner for developing electrostatic latent image 7 obtained through dynamic viscoelastometry, is $4.9\times10^2$ Pas, and the loss tangent tan δ thereof is 1.30.

<Production of Comparative Toner 1>

Except for using a binder resin particle dispersion liquid that is prepared by removing the graft polymer 1 from the binder resin particle dispersion liquid 1, a similar operation to that of the toner for developing electrostatic latent images 1 is performed to produce the comparative toner 1.

<Production of Comparative Toner 2>

Except for using a binder resin particle dispersion liquid that is prepared by removing the graft polymer 1 from the binder resin particle dispersion liquid 1, a similar operation to that of the toner for developing electrostatic latent image 2 is performed to produce the comparative toner 2.

<Production of Comparative Toner 3>

Except for using a binder resin particle dispersion liquid that is prepared by removing the graft polymer 3 from the binder resin particle dispersion liquid 3, a similar operation to that of the toner for developing electrostatic latent image 3 is performed to produce the comparative toner 3.

<Production of Comparative Toner 4>

Except for using a binder resin particle dispersion liquid that is prepared by removing the graft polymer 2 from the binder resin particle dispersion liquid 2, a similar operation to that of the toner for developing electrostatic latent image 4 is performed to produce the comparative toner 4.

<Formulation of Developer for Electrostatic Latent Image>

100 parts of each toner for developing electrostatic latent image (toner) 1 to 7 and comparative toner 1 to 4 is added with 3.0 parts of hydrophobic silica (TS720, manufactured by Cabot), and blended in a sample mill to obtain external toners (1) to (7), and comparative external toners (1) to (4). Moreover, ferrite carrier cores having an average particle diameter of 50 μm are coated with a methacrylate (manufactured by Soken Chemical & Engeneering Co., Ltd.) to prepare a 1% methacrylate-coated carrier. The external toner and the coated carrier are weighed so as to have an external toner concentration of 5%, and stirred in a ball mill for 5 minutes to form the developers for electrostatic latent images (1) to (7), and the comparative developers for electrostatic latent images (1) to (4).

Examples 1 to 7 and Comparative Examples 1 to 4

Each developer for electrostatic latent image (1) to (7) and comparative electrostatic latent image developer (1) to (4) is applied to a copy machine (fixing unit is belt type) that is modified from a Fuji Xerox's copy machine, A Color 635 Model, and evaluated for the developability. The nip width in the fixing unit is set to 6.5 mm, the fixation speed is adjusted to 200 mm/sec, and the pressure is adjusted to 2.5 kg/cm$^2$, so as to perform the fixation test under high-speed, low-pressure, and low-power conditions. The matters evaluated are (i) the presence or absence of resistance in releasing the transfer paper from the fixing unit (releasability), and (ii) the presence or absence of offset (offset resistance), measured by the following methods. The results are shown in Table 1.

<Releasability>

Fuji Xerox's P sheet is used as the test sheet. The test is performed with a 10.5 g/m$^2$ dose of toner at a fixing temperature of 160° C. The condition of the test sheet after it has passed through the fusing unit is visually judged.

<Offset Resistance>

Fuji Xerox's P sheet is used as the test sheet. The test is performed with a 10.5 g/m$^2$ dose of toner and by increasing the fixing temperature by 10° C. from 160° C. up to 210° C. The condition of offset image occurrence at the time of fixing is visually judged. If no occurrence is found, it is judged as good.

Example 8

Each of the developers for electrostatic latent image (2), (3), and (4) is applied to a copy machine that is modified from a Fuji Xerox's copy machine, DocuCentre 1250 Model, to form a primary color, a secondary color, and a tertiary color. The respective glosses after laying the colors are measured to obtain the gloss difference. The modified copier is manufactured by modifying the fixing unit of the Fuji Xerox's copy machine, DocuCentre 1250 Model, into a fixing unit having a variable nip pressure using a rubber roll covered with a perfluoroalkoxy resin. The fixation test is performed by setting the nip pressure to 2.5 kg/cm$^2$ and using Fuji Xerox's J sheet (basis weight of 82 g/m$^2$), and the respective tests are performed in the above method. The results are shown in Table 1.

Example 9

The developer for electrostatic latent image (2) is applied to a copy machine that has been modified from a Fuji Xerox's copy machine, A Color 635 Model, and evaluated for developability. The modified copy machine is manufactured by modifying the fixing unit into a roll type fixing uni (refer to "a part of fixing unit of FIG. 2"). The fixation condition is the same except for the fixation speed of 160 mm/sec. The results are shown in Table 1.

[Odor Test by Sensory Evaluation]

In Examples 1 to 9 and Comparative Examples 1 to 4, the odor is judged by printing 1000 charts having an image area of 20%, in a sealed booth having a floor area of 4.5 m×4.5 m and a height of 3 m, and judging the fixation odor at that time by 20 examinees. The results are shown in Table 1.

TABLE 1

| | Type of Toner Particle | Type of Fixing unit | Fixation speed (mm/sec) | Releasability | Offset resistance | Number of people who smelled odor |
|---|---|---|---|---|---|---|
| Example 1 | Toner 1 | belt type | 200 | good | good | zero |
| Example 2 | Toner 2 | belt type | 200 | good | good | zero |
| Example 3 | Toner 3 | belt type | 200 | good | good | zero |
| Example 4 | Toner 4 | belt type | 200 | good | good | zero |
| Example 5 | Toner 5 | belt type | 200 | good | good | zero |
| Example 6 | Toner 6 | belt type | 200 | good | good | zero |
| Example 7 | Toner 7 | belt type | 200 | good | good | zero |
| Example 8 | Toner 2, 3, 4 | belt type | 200 | good | good | zero |
| Example 9 | Toner 2 | roll type | 160 | good | good | zero |
| Comparative Example 1 | Comparative Toner 1 | belt type | 200 | good | good | 19 |
| Comparative Example 2 | Comparative Toner 2 | belt type | 200 | good | good | 19 |
| Comparative Example 3 | Comparative Toner 3 | belt type | 200 | good | good | 20 |
| Comparative Example 4 | Comparative Toner 4 | belt type | 200 | good | slightly present at 210° C. | 19 |

As is apparent from Table 1, it is found that the toner for developing electrostatic latent images of the present invention does not generate odor, and shows fixity even in an image forming apparatus comprising a fixing unit of a high-speed, low-pressure, and low-power type.

As described above, the toner for developing electrostatic latent images of the present invention is superior in fixity and can suppress odor generation at the time of fixing. Moreover, according to the method of producing the toner for developing electrostatic latent images of the present invention, a toner having a small particle diameter can be produced. Furthermore, according to the developer of electrostatic latent images, the image forming method, and the image forming apparatus of the present invention, the odor generation at the time of fixing can be suppressed.

What is claimed is:

1. A toner for developing electrostatic latent images comprising:

a binder resin, a colorant, a releasing agent, and a graft polymer produced by graft polymerization of a resin matrix and a macromonomer, the macromonomer comprising at least one group selected from the group consisting of:

a hydroxyl group, a hydroxyalkyl group, and a pyrolidonyl group, wherein:

a complex viscosity η* of the toner at 160° C., obtained by temperature dispersion analysis of the toner in a sinusoidal oscillation method, is between $3.0\times10^2$ and $1.2\times10^3$ Pas, and a loss tangent tan δthereof is between 0.6 and 1.8.

2. The toner for developing electrostatic latent image according to claim 1, wherein a degree of polymerization of the macromonomer is between 10 and 100.

3. The toner for developing electrostatic latent image according to claim 1, wherein the macromonomer comprises a cationic leaving group.

4. The toner for developing electrostatic latent image according to claim 3, wherein the cationic leaving group is at least one group selected from the group consisting of a carboxyl group, a sulfone group, a phosphate group, a sulfoethyl group, a phosphomethyl group, and a carbomethyl group.

5. The toner for developing electrostatic latent image according to claim 1, wherein the macromonomer comprises an anionic leaving group.

6. The toner for developing electrostatic latent image according to claim 5, wherein the anionic leaving group is at least one group selected from the group consisting of a primary to tertiary amino group and a quaternary ammonium group.

7. The toner for developing electrostatic latent image according to claim 1, wherein the resin matrix is at least one type selected from the group consisting of a cellulosic resin, a polyolefin resin, a polyacrylonitrile resin, a polyester resin, and a polyamide resin.

8. The toner for developing electrostatic latent image according to claim 1, wherein an acid value of the releasing agent is less than an acid value of the binder resin.

9. The toner for developing electrostatic latent images according to claim 1, wherein a volume-average particle size distribution index GSDv is 1.30 or less, and a ratio of the volume-average particle size distribution index GSDv to a number-average particle size distribution index GSDp is at least 0.95.

10. The toner for developing electrostatic latent images according to claim 1, wherein a shape factor SF1 thereof is between 100 and 130.

11. A method of producing a toner for developing electrostatic latent images according to claim 1 comprising:

mixing, so as to form aggregated particles, at least:

a binder resin particle dispersion liquid in which a binder resin having a particle diameter of 1 μm or less is dispersed, a colorant dispersion liquid in which the colorant is dispersed, a releasing agent dispersion liquid in which the releasing agent is dispersed, and the graft polymer; and heating the aggregated particles to a temperature equal to or greater than a glass transition point or a melting point of the binder resin, so as to fuse and coalesce the aggregated particles, wherein:

a complex viscosity η* of the toner at 160° C., obtained by temperature dispersion analysis of the toner in a sinusoidal oscillation method, is between $3.0\times10^2$ and $1.2\times10^3$ Pas, and a loss tangent tan δthereof is between 0.6 and 1.8.

12. The method of producing a toner for developing electrostatic latent images according to claim 11, comprising:

obtaining the resin particle dispersion liquid, the resin particle dispersion liquid further comprising the binder resin and the graft polymer;

mixing, so as to form aggregated particles, at least:

the resin particle dispersion liquid, the colorant dispersion liquid, and the releasing agent dispersion liquid; and heating the aggregated particles to a temperature equal or greater than the glass transition point or the melting point of the binder resin, so as to fuse and coalesce the aggregated particles.

13. The method of producing a toner for developing electrostatic latent images according to claim 11, comprising:

dispersing, at least:

the colorant, the releasing agent, a polymerization initiator, and the graft polymerin a polymerizable monomer so as to obtain a dispersion liquid;

suspending the dispersion liquid in water so as to obtain a suspension liquid; and heating the suspension liquid so as to polymerize the polymerizable monomer.

14. The method of producing a toner for developing electrostatic latent images according to claim 11, comprising:

prepolymerizing a polymerizable monomer so as to obtain a polymeride having a weight average molecular weight (Mw) of 3000 to 15000 measured by gel permeation chromatography (GPC);

dispersing, at least:

the polymeride, the polymerizable monomer, a polymerization initiator, the releasing agent, the colorant, and the graft polymer in an organic solvent so as to obtain a dispersion liquid;

suspending the dispersion liquid in water so as to obtain a suspension liquid; and heating the suspension liquid so as to polymerize the polymeride and the polymerizable monomer.

15. A method of producing a toner for developing electrostatic latent images according to claim 11 comprising:

dissolving, at least:

the binder resin, the colorant, the releasing agent, and the graft polymer in an organic solvent so as to obtain a dispersion liquid;

suspending the dispersion liquid in water so as to obtain a suspension liquid; and separating the suspension liquid into solid and liquid.

16. An electrostatic latent image developer comprising the toner for developing electrostatic latent images according to claim 1 and a carrier.

17. An image forming method comprising:

uniformly charging a surface of an image holding material;

forming a latent image on the surface of the charged image holding material;

developing the latent image formed on the surface of the image holding material with the developer of claim 16, so as to form a toner image;

transferring the toner image formed on the surface of the image holding material onto a transfer material;

fixing the transferred toner image; and removing residual toner present on the surface of the image holding material after the transfer.

* * * * *